US010917942B2

(12) United States Patent
Kim et al.

(10) Patent No.: US 10,917,942 B2
(45) Date of Patent: Feb. 9, 2021

(54) STRUCTURE, PLANAR HEATER INCLUDING THE SAME, HEATING DEVICE INCLUDING THE PLANAR HEATER, AND METHOD OF PREPARING THE STRUCTURE

(71) Applicant: Samsung Electronics Co., Ltd., Suwon-si (KR)

(72) Inventors: Jinhong Kim, Seoul (KR); Seyun Kim, Seoul (KR); Haengdeog Koh, Hwaseong-si (KR); Doyoon Kim, Hwaseong-si (KR); Hajin Kim, Hwaseong-si (KR); Soichiro Mizusaki, Suwon-si (KR); Minjong Bae, Yongin-si (KR); Changsoo Lee, Seoul (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 270 days.

(21) Appl. No.: 16/045,834

(22) Filed: Jul. 26, 2018

(65) Prior Publication Data

US 2019/0037644 A1 Jan. 31, 2019

(30) Foreign Application Priority Data

Jul. 31, 2017 (KR) ..... 10-2017-0097128
Jul. 3, 2018 (KR) ..... 10-2018-0077330

(51) Int. Cl.
*H05B 1/02* (2006.01)
*H05B 3/14* (2006.01)
*H05B 3/26* (2006.01)

(52) U.S. Cl.
CPC ..... *H05B 1/0294* (2013.01); *H05B 3/262* (2013.01)

(58) Field of Classification Search
CPC ..... H05B 1/0294; H05B 3/262; H05B 3/141; H05B 3/16

(Continued)

(56) References Cited

U.S. PATENT DOCUMENTS 4,973,826 A 11/1990 Baudry et al.
7,648,930 B2 1/2010 Fechner et al.

(Continued)

FOREIGN PATENT DOCUMENTS

EP 0319079 A1 6/1989
EP 1604620 A1 12/2005

(Continued)

OTHER PUBLICATIONS

EESR issued by the European Patent Office dated Dec. 12, 2018 in the examination of the European Patent Application No. 18186396.0, which corresponds to the U.S. Appl. No. 16/045,834.

*Primary Examiner* — Quang T Van
(74) *Attorney, Agent, or Firm* — Cantor Colburn LLP

(57) ABSTRACT

Provided are a structure, a planar heater including the same, a heating device including the planar heater, and a method of preparing the structure. The structure includes a metal substrate, an insulating layer disposed on the metal substrate, an electrode layer disposed on the insulating layer, and an electrically conductive layer disposed on the electrode layer, wherein a difference in a coefficient of thermal expansion (CTE) between the metal substrate and the insulating layer is 4 parts per million per degree Kelvin change in temperature (ppm/K) or less.

35 Claims, 11 Drawing Sheets

(58) Field of Classification Search
USPC ..... 219/675, 690–693, 619, 121.67, 121.78, 219/203, 213, 216, 219, 388, 444.1, 478, 219/542, 553, 537, 533; 156/196; 438/795, 487, 479
See application file for complete search history.

(56) References Cited

U.S. PATENT DOCUMENTS

| | | | | |
|---|---|---|---|---|
| 7,695,831 | B2 | 4/2010 | Shon et al. | |
| 8,962,162 | B2 | 2/2015 | Benford, Jr. et al. | |
| 9,217,970 | B2 | 12/2015 | Fudo et al. | |
| 9,296,644 | B2 | 3/2016 | Schoen | |
| 9,598,307 | B2 | 3/2017 | Miwa et al. | |
| 10,081,568 | B2 | 9/2018 | Plevacova et al. | |
| 2010/0045164 | A1 | 2/2010 | Fechner et al. | |
| 2011/0188838 | A1* | 8/2011 | Abbott | F27D 11/12 392/407 |
| 2011/0198029 | A1 | 8/2011 | Schoen | |
| 2012/0118873 | A1 | 5/2012 | Erismis et al. | |
| 2012/0247641 | A1 | 10/2012 | Ruggiero et al. | |
| 2014/0109962 | A1 | 4/2014 | Kobayashi et al. | |
| 2014/0110637 | A1 | 4/2014 | Labranche et al. | |
| 2014/0353303 | A1 | 12/2014 | Fudo et al. | |
| 2015/0030856 | A1 | 1/2015 | Singh et al. | |
| 2015/0247316 | A1 | 9/2015 | Coupe | |
| 2015/0274579 | A1 | 10/2015 | Plevacova et al. | |
| 2017/0050880 | A1 | 2/2017 | Plevacova et al. | |
| 2018/0029926 | A1 | 2/2018 | Sato et al. | |
| 2018/0136181 | A1 | 5/2018 | Bae et al. | |
| 2019/0037645 | A1* | 1/2019 | Kim | C03C 4/16 |

FOREIGN PATENT DOCUMENTS

| | | | |
|---|---|---|---|
| EP | 1842832 | A1 | 10/2007 |
| JP | S60197335 | A | 10/1985 |
| JP | H06140132 | A | 5/1994 |
| JP | H07297267 | A | 11/1995 |
| JP | 2001102158 | A | 4/2001 |
| KR | 1020060121104 | A | 11/2006 |
| KR | 100693938 | B1 | 3/2007 |
| KR | 1020080024086 | A | 3/2008 |
| KR | 100849421 | B1 | 7/2008 |
| KR | 101457164 | B1 | 11/2014 |
| KR | 1020150081270 | A | 7/2015 |
| KR | 101639226 | B1 | 7/2016 |
| KR | 1020160146746 | A | 12/2016 |
| KR | 1020180054433 | A | 5/2018 |
| WO | 2008150171 | A1 | 12/2008 |
| WO | 2016129543 | A1 | 8/2016 |

* cited by examiner

STRUCTURE, PLANAR HEATER INCLUDING THE SAME, HEATING DEVICE INCLUDING THE PLANAR HEATER, AND METHOD OF PREPARING THE STRUCTURE

CROSS-REFERENCE TO RELATED APPLICATION

This application claims priority to and the benefit of Korean Patent Application No. 10-2017-0097128, filed on Jul. 31, 2017, in the Korean Intellectual Property Office, and Korean Patent Application No. 10-2018-0077330, filed on Jul. 3, 2018, in the Korean Intellectual Property Office, and all the benefits accruing therefrom under 35 U.S.C. § 119, the contents of which are incorporated herein in their entireties by reference.

BACKGROUND

1. Field

The present disclosure relates to a structure, a planar heater including the same, a heating device including the planar heater, and a method of preparing the structure.

2. Description of the Related Art

A planar heating oven is an example of a heating device including a planar heater. A planar heating oven may have a driving temperature of 300° C., which may increase up to 500° C. during a pyro self-clean operation.

In commercial ovens using a sheath heater, short circuits may be prevented by using a ceramic filler powder or the like only in regions of contact with the heater.

In the case of a planar heating oven, all surfaces are in contact with a conductive material, and each of the surfaces desirably has insulating properties.

Since enamel used in commercial ovens may lose insulating properties at a temperature of 200° C. or higher, an insulator to replace enamel is desired.

SUMMARY

Provided are structures having insulating properties even at a high temperature of 500° C. or higher and a desirable adhesive force between a substrate and an insulating layer.

Provided are planar heaters including the structures.

Provided are heating devices including the planar heaters.

Provided are methods of preparing, by a relatively easy process, the structures having a large area, e.g., large surface area or large size, and applicable to various fields.

Additional aspects will be set forth in part in the description which follows and, in part, will be apparent from the description, or may be learned by practice of the presented embodiments.

According to an aspect of an embodiment, a structure includes a metal substrate, an insulating layer disposed on the metal substrate, an electrode layer disposed on the insulating layer, and an electrically conductive layer disposed on the electrode layer, wherein a difference in a coefficient of thermal expansion (CTE) between the metal substrate and the insulating layer is 4 parts per million per degree Kelvin change in temperature (ppm/K) or less.

According to an embodiment, a planar heater includes the structure.

According to an embodiment, a heating device includes the planar heater.

According to an embodiment, a method of preparing the structure includes preparing a metal substrate, forming an insulating layer on the metal substrate by coating an insulator composition on the metal substrate and heat-treating the insulator composition, forming an electrode layer on the insulating layer by coating an electrode layer forming composition on the insulating layer and heat-treating the electrode layer forming composition, and forming an electrically conductive layer on the electrode layer by coating an electrically conductive composition on the electrode layer and heat-treating the electrically conductive composition.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
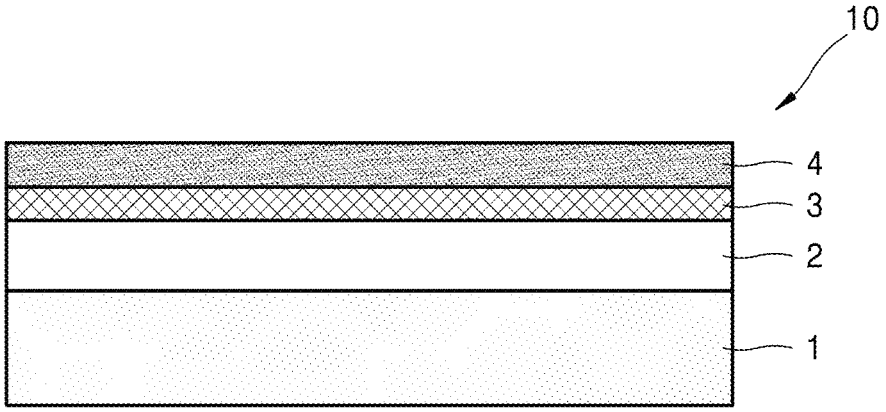
FIG. 1 is a schematic diagram of a structure according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

Hereinafter, a structure, a planar heater including the same, a heating device including the planar heater, and a method of preparing the structure according to an embodiment will be described in detail.

The present embodiments are exemplarily provided without limiting the scope of the present disclosure and the present disclosure is defined only by the following claims. Shapes and sizes of elements in the drawings may be exaggerated for the convenience of description.

Throughout the specification, the terms "include" and "have" are intended to indicate the existence of elements disclosed in the specification and are not intended to preclude the possibility that one or more elements may exist or may be added.

Throughout the specification, it will be understood that when one element such as a layer, a film, or a region is referred to as being "on" or "above" another element, it can be directly on the other element, or intervening elements may also be present therebetween. On the contrary, when one element is referred to as being "directly on" or "directly above", there is no intervening elements therebetween.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or."

Furthermore, relative terms, such as "lower" and "upper," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure.

"About" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±10%, or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a schematic diagram of a structure 10 according to an embodiment.

Referring to FIG. 1, the structure 10 according to an embodiment may include: a metal substrate 1; an insulating layer 2 disposed on the metal substrate 1; an electrode layer 3 disposed on the insulating layer 2; and an electrically conductive layer 4 disposed on the electrode layer 3. A difference in coefficient of thermal expansion CTE between the metal substrate 1 and the insulating layer 2 may be about 4 ppm/K or less.

The insulating layer 2, the electrode layer 3, and the electrically conductive layer 4 may be sequentially disposed on the metal substrate 1 in the form of "layer" in the structure 10, a current may uniformly flow over the entire layer, and the structure 10 may be insulated and/or generate heat uniformly. When the insulating layer 2 or the electrically conductive layer 4 is disposed in the form of "solder", there may be a difference in electrical conductivity between the insulating layer 2 and/or the electrically conductive layer 4 due to, for example, a compositional difference therebetween, and a structure formed therewith may not be insulated and/or generate heat uniformly.

A difference in coefficient of thermal expansion CTE between the metal substrate 1 and the insulating layer 2 of the structure 10 may be about 4 ppm/K or less, for example, about 3.5 ppm/K or less, for example, about 3 ppm/K or less, for example, about 2.5 ppm/K or less, and for example, about 2 ppm/K. In some embodiments, the CTE is measured over a temperature range of 25° C. to 600° C.

The metal substrate 1 may have a coefficient of thermal expansion CTE of, for example, from about 11 ppm/K to about 13 ppm/K, for example about 12 ppm/K. The metal substrate 1 may include a material of iron (Fe), low carbon steel (SPP), aluminum (Al), magnesium (Mg), titanium (Ti), zirconium (Zr), zinc (Zn), niobium (Nb), silver (Ag), gold (Au), copper (Cu), or an alloy thereof, without being limited thereto. The insulating layer 2 may have a coefficient of thermal expansion CTE of, for example, from about 8 ppm/K to about 12 ppm/K, for example, from about 8 ppm/K to about 11 ppm/K, and for example, from about 8 ppm/K to about 10 ppm/K. Due to, for example, the difference in coefficient of thermal expansion CTE between the metal substrate 1 and the insulating layer 2, stress caused by, for example, thermal deformation may be reduced.

An insulating layer may further be disposed under the metal substrate 1, if desired. The insulating layer disposed under the metal substrate may have a composition and/or content, e.g., amounts of various components thereof, that is the same as or different from those of the insulating layer 2.

The insulating layer 2 may be an insulator film formed on the entire upper surface of the metal substrate 1. The insulator film may provide uniform insulating properties between the metal substrate 1 and the electrode layer 3 and the electrically conductive layer 4 disposed thereon and may serve as a protective layer to protect the structure 10 from external impact. The insulator film may have a large contact area, and the structure may be manufactured in a large area, e.g., manufactured to have a large surface area or large size.

The insulating layer 2 may have a thickness of from about 100 micrometers (μm) to about 300 μm. The insulating layer 2 may have a thickness of, for example, from about 100 μm to about 280 μm, for example, from about 100 μm to about 250 μm, for example, from about 100 μm to about 230 μm, for example, from about 100 μm to about 200 μm, and for example, from about 100 μm to about 180 μm. When the thickness of the insulating layer 2 is less than the ranges described above, insulating effects may be negligible and the insulating layer 2 may break by external impact. When the thickness of the insulating layer 2 is greater than the ranges described above, manufacturing costs may increase or heating efficiency may decrease, and the insulating layer 2 may be appropriately used within the above ranges. The insulating layer 2 may be a single layer or a plurality of layers if desired.

The insulating layer 2 may include an insulator of glass, oxide glass, a ceramic-glass composite, or a combination thereof. The insulating layer 2 may have excellent electrical insulation, thermal stability, waterproofness, and heat resistance. The insulating layer 2 may include, for example, glass.

The insulator may have a glass transition temperature Tg of about 500° C. or higher. The "glass transition temperature" as a value indicating heat resistance may be measured by thermomechanical analysis (TMA), dynamic mechanical analysis (DMA), or the like. The thermomechanical analysis (TMA) may be performed by using, for example, a TMA-SS6100 (manufactured by Seiko Instruments Inc.) or a TMA-8310 (manufactured by Rigaku Corporation) and the dynamic mechanical analysis (DMA) may be performed by using, for example, a DMS-6100 (manufactured by Seiko Instruments Inc.). If the insulator has a glass transition temperature Tg of about 500° C. or higher, the insulator may have excellent oxidation resistance and a current flow may be efficiently blocked even at a high temperature of about 500° C. or higher so as to obtain stable insulating properties.

The insulator may be a mixture satisfying Equation 1 below.

$$\text{INS}=a\text{BaO}+b\text{SiO}_2+c\text{Al}_2\text{O}_3+d\text{B}_2\text{O}_3+e\text{NiO}+f\text{CoO}+g(\text{SrO}, \text{Cr}_2\text{O}_3, \text{Y}_2\text{O}_3, \text{Fe}_2\text{O}_3, \text{MgO}, \text{TiO}_2, \text{ZrO}_2, \text{or a combination thereof})+h(\text{Li}_2\text{O}, \text{Na}_2\text{O}, \text{K}_2\text{O}, \text{or a combination thereof}) \quad \text{Equation 1}$$

In Equation 1,

INS represents a total weight of the insulator;

$1.0 \le a/b \le 5.0$;

0.1% by weight$\le e \le$3.0% by weight;

0.1% by weight$\le f \le$3.0% by weight;

0.1% by weight$\le g \le$30% by weight;

0.1% by weight$\le h \le$2.2% by weight;

a+b+c+d+e+f+g+h is equal to 100% by weight; and c+d equals 100−a−b−e−f−g−h.

Accordingly, it is to be understood that INS represents a total weight of the insulator and is 100% by weight; and in g and h, at least one of components indicated in corresponding brackets are included therein, respectively.

In Equation 1, the a/b ratio may be from about 1 to about 5, for example, from about 1 to about 4.4, for example, from about 1 to about 4.3, for example, from about 1 to about 4.2, for example, from about 1 to about 4.1, for example, from about 1 to about 4, for example, from about 1 to about 3.9, for example, from about 1 to about 3.8, for example, from about 1 to about 3.7, for example, from about 1 to about 3.6, for example, from about 1 to about 3.5, for example, from about 1 to about 3.4, for example, from about 1 to about 3.3, for example, from about 1 to about 3.2, for example, from about 1 to about 3.1, for example, from about 1 to about 3, for example, from about 1 to about 2.9, for example, from about 1 to about 2.8, for example, from about 1 to about 2.7, for example, from about 1 to about 2.6, for example, from about 1 to about 2.5, for example, from about 1 to about 2.4, for example, from about 1.3 to about 2.3, for example, from about 1.3 to about 2.2, for example, from about 1.3 to about 2.1, for example, from about 1.3 to about 2, for example, from about 1.3 to about 1.9, for example, from about 1.3 to about 1.8, and for example, from about 1.3 to about 1.7. When the a/b ratio is within the above ranges, the coefficient of thermal expansion CTE of the insulating layer 2 increases, the difference in coefficient of thermal expansion CTE between the metal substrate 1 and the insulating layer 2 may be maintained within about 4 ppm/K, and stress caused by, for example, thermal deformation may be reduced.

In Equation 1, the coefficient a may be from about 0.1% by weight to about 55% by weight, for example, from about 0.1% by weight to about 40% by weight, for example, from about 0.1% by weight to about 35% by weight, and for example, from about 0.1% by weight to about 30% by weight. In Equation 1, the b may be from about 0.1% by weight to about 40% by weight, for example, from about 0.1% by weight to about 35% by weight, for example, from about 0.1% by weight to about 25% by weight, and for example, from about 0.1% by weight to about 15.0% by weight.

In Equation 1, the coefficient e may be from about 0.1% by weight to about 3% by weight, for example, from about 0.1% by weight to about 2.8% by weight, for example, from about 0.1% by weight to about 2.6% by weight, for example, from about 0.1% by weight to about 2.4% by weight, for example, from about 0.1% by weight to about 2.2% by weight, for example, from about 0.1% by weight to about 2% by weight, for example, from about 0.1% by weight to about 1.8% by weight, for example, from about 0.1% by weight to about 1.6% by weight, for example, from about 0.1% by weight to about 1.4% by weight, for example, from about 0.1% by weight to about 1.2% by weight, for example, from about 0.1% by weight to about 1% by weight, for example, from about 0.1% by weight to about 0.8% by weight, for example, from about 0.1% by weight to about 0.6% by weight, for example, from about 0.1% by weight to about 0.4% by weight, and for example, from about 0.1% by weight to about 0.2% by weight. Ni has higher chemical reactivity than a metal of the metal substrate 1, and chemical bonding between the metal substrate 1 and the insulating layer 2 may be enhanced by NiO. When the coefficient e is within these ranges, a desirable adhesive force may be obtained between the metal substrate 1 and the insulating layer 2. For example, when the metal substrate 1 is an iron (Fe) plate and the insulating layer 2 includes NiO, a mechanism of chemical reaction may be represented by Equation 2 below:

$$2Fe+3NiO \rightarrow Fe_2O_3+3Ni \quad \text{Equation 2}$$

In Equation 1, the coefficient f may be for example, from about 0.1% by weight to about 2.8% by weight, for example, from about 0.1% by weight to about 2.6% by weight, for example, from about 0.1% by weight to about 2.4% by weight, for example, from about 0.1% by weight to about 2.2% by weight, for example, from about 0.1% by weight to about 2% by weight, for example, from about 0.1% by weight to about 1.8% by weight, and for example, from about 0.1% by weight to about 1.6% by weight. Co has higher chemical reactivity than the metal of the metal substrate 1, and chemical bonding between the metal substrate 1 and the insulating layer 2 may be enhanced by CoO. When the coefficient f is within these ranges, a desirable adhesive force may be obtained between the metal substrate 1 and the insulating layer 2. For example, when the metal substrate 1 is an iron (Fe) plate and the insulating layer 2 includes CoO, a mechanism of chemical reaction may be represented by Equation 3 below:

$$2Fe+3CoO \rightarrow Fe_2O_3+3Co \quad \text{Equation 3}$$

In Equation 1, the coefficient g may be for example, from about 0.1% by weight to about 30% by weight, for example, from about 0.1% by weight to about 29% by weight, for example, from about 0.1% by weight to about 28% by weight, and for example, from about 0.1% by weight to about 27% by weight. The coefficient g may be a total amount of the SrO component, the $Cr_2O_3$ component, the $Y_2O_3$ component, the $Fe_2O_3$ component, the MgO component, the $TiO_2$ component, the $ZrO_2$ component, or a combination thereof. For example, the coefficient g may be an amount of a combination of the SrO component, the $Cr_2O_3$ component, the $Y_2O_3$ component, the $Fe_2O_3$ component, the MgO component, the $TiO_2$ component, and the $ZrO_2$ component.

For example, an amount of the SrO component may be from about 0.1% by weight to about 10% by weight, for example, from about 0.1% by weight to about 5% by weight, and for example, from about 0.1% by weight to about 3% by weight. For example, an amount of the $Cr_2O_3$ component may be from about 0% by weight to about 5% by weight, for example, from about 0.1% by weight to about 3% by weight, and for example, from about 0.1% by weight to about 1% by weight. For example, an amount of the $Y_2O_3$ component may be from about 0% by weight to about 5% by weight, for example, from about 0.1% by weight to about 3% by weight, and for example, from about 0.1% by weight to about 1% by weight. For example, an amount of the $Fe_2O_3$ component may be from about 0.1% by weight to about 5% by weight, for example, from about 0.1% by weight to about 3% by weight, and for example, from about 0.1% by weight to about 2% by weight. For example, an amount of the MgO component may be from about 0.1% by weight to about 25% by weight, for example, from about 0.1% by weight to about 15% by weight, and for example, from about 0.1% by weight to about 10% by weight. For example, an amount of the $TiO_2$ component may be from about 0.1% by weight to about 10% by weight, for example, from about 0.1% by weight to about 6% by weight, and for example, from about 0.1% by weight to about 1% by weight. For example, an amount of the $ZrO_2$ component may be from about 0.1% by weight to about 10% by weight, for example, from about 0.1% by weight to about 8% by weight, and for example, from about 0.1% by weight to about 1% by weight. Some of these components may serve as pigments of the insulator, and the amounts of these components are not particularly limited and may be appropriately adjusted within the ranges of the coefficient g described above.

In Equation 1, the coefficient h may be from 0.1% by weight to 2.2% by weight, for example, from 0.1% by weight to 2.1% by weight, for example, from 0.1% by weight to 2% by weight, for example, from 0.1% by weight to 1.9% by weight, for example, from 0.1% by weight to 1.8% by weight, for example, from 0.1% by weight to 1.7% by weight, for example, from 0.1% by weight to 1.6% by weight, for example, from 0.1% by weight to 1.5% by weight, for example, from 0.1% by weight to 1.4% by weight, for example, from 0.1% by weight to 1.3% by weight, for example, from 0.1% by weight to 1.2% by weight, for example, from 0.1% by weight to 1.1% by weight, for example, from 0.1% by weight to 1% by weight, for example, from 0.1% by weight to 0.9% by weight, for example, from 0.1% by weight to 0.8% by weight, for example, from 0.1% by weight to 0.7% by weight, for example, from 0.1% by weight to 0.6% by weight, for example, from 0.1% by weight to 0.5% by weight, for example, from 0.1% by weight to 0.4% by weight, and for example, from 0.1% by weight to 0.35% by weight. The coefficient h may be a total amount of the $Li_2O$ component, the $Na_2O$ component, the $K_2O$ component, or a combination thereof. For example, the coefficient h may be an amount of a combination of the $Li_2O$ component, the $Na_2O$ component, and the $K_2O$ component.

For example, an amount of the $Li_2O$ component may be from 0% by weight to 0.5% by weight, for example, from 0.1% by weight to 0.3% by weight, and for example, from 0.1% by weight to 0.2% by weight. For example, an amount of the $Na_2O$ component may be from 0% by weight to 2.2% by weight, for example, from 0.1% by weight to 1% by weight, and for example, from 0.1% by weight to 0.5% by weight. For example, an amount of the $K_2O$ component may be from 0% by weight to 2.2% by weight, for example, from 0.1% by weight to 1% by weight, and for example, from 0.1% by weight to 0.5% by weight. The amounts of these components are not particularly limited and may be appropriately adjusted within the ranges of the coefficient h described above.

All of these components are alkali metal components and have cations ($Li^+$, $Na^+$, and $K^+$) with very small radii and low electrovalences. In an insulator including a large amount of these components, electrically conductive paths may be generated, a thermal breakdown phenomenon in which internal discharges may occur in the insulator, and the insulator may break down and lose insulating properties. A representative example of the insulator exhibiting such a thermal breakdown phenomenon is enamel. Enamel includes alkali metal components in an amount of about 11% by weight or greater, and a leakage current may increase as a temperature thereof increases. Enamel may lose insulating properties at a temperature of about 200° C. or higher, and the use of enamel as an insulator may be limited at a high temperature. The insulator according to an embodiment may efficiently block a current flow and may have excellent insulating properties even at a high temperature of about 500° C. or higher when the coefficient h is within the ranges described above in Equation 1, and the insulator may be stable.

In Equation 1, the coefficient c+d represents a remaining weight percent excluding a, b, e, f, g, and h from the total weight of the insulator, i.e., c+d equals 100−a−b−e−f−g−h.

For example, the coefficient c may be from about 0.1% by weight to about 10% by weight, for example, from about 0.1% by weight to about 8% by weight, for example, from about 0.1% by weight to about 6% by weight, for example, from about 0.1% by weight to about 4% by weight, for example, from about 0.1% by weight to about 2% by weight, for example, from about 0.1% by weight to about 1% by weight, and for example, from about 0.1% by weight to about 0.8% by weight. For example, the coefficient d may be from about 0.1% by weight to about 20% by weight, for example, from about 0.1% by weight to about 18% by weight, for example, from about 0.1% by weight to about 16% by weight, for example, from about 0.1% by weight to about 15% by weight, for example, from about 0.1% by weight to about 10% by weight, for example, from about 0.1% by weight to about 8% by weight, and for example, from about 0.1% by weight to about 5% by weight.

The insulator may be a mixture satisfying Equation 1a below.

$$INS_1 = a_1BaO + b_1SiO_2 + c_1Al_2O_3 + d_1B_2O_3 + e_1NiO + f_1CoO + g_1(SrO, Cr_2O_3, Y_2O_3, Fe_2O_3, MgO, TiO_2, ZrO_2, \text{or a combination thereof}) + h_1(Li_2O, Na_2O, K_2O, \text{or a combination thereof}) + i_1(CaO, ZnO, \text{or a combination thereof})$$

In Equation 1a, $INS_1$ represents a total weight of the insulator;

$1.0 \le a_1/b_1 \le 5.0$;

0.1% by weight$\le e_1 \le$3.0% by weight;

0.1% by weight$\le f_1 \le$3.0% by weight;

0.1% by weight$\le g_1 \le$30% by weight;

0.1% by weight$\le h_1 \le$2.2% by weight;

0.1% by weight$\le i_1 \le$5.0% by weight;

$a_1+b_1+c_1+d_1+e_1+f_1+g_1+h_1+i_1$ is equal to 100% by weight; and $c_1+d_1$ equals equal to $100-a_1-b_1-e_1-f_1-g_1-h_1-i_1$.

In Equation 1a, the $a_1/b_1$ ratio, $a_1$, $d_1$, $e_1$, $f_1$, $g_1$, and $h_1$ are the same as the a/b ratio, a, b, c+d, c, d, e, f, g, and h described above with reference to Equation 1, and thus detailed descriptions thereof will not be repeated.

In Equation 1 a, the coefficient $i_1$ may be from 0.1% by weight to 5% by weight, for example, from 0.1% by weight to 4% by weight, for example, from 0.1% by weight to 3% by weight, for example, from 0.1% by weight to 2% by weight, and for example, from 0.1% by weight to 1% by weight. The coefficient $i_1$ may be an amount of the CaO component, the $TiO_2$ component, the ZnO component, the $ZrO_2$ component, or a combination thereof. For example, the coefficient $i_1$ may be an amount of a combination of the CaO component and the ZnO component.

The insulator may further include an inorganic filler to enhance heat resistance, electrical conductivity, and/or strength. Examples of the inorganic filler may include calcium carbonate, magnesium carbonate, calcium sulfate, magnesium sulfate, iron oxide, zinc oxide, magnesium oxide, aluminum oxide, calcium oxide, titanium oxide, calcium hydroxide, magnesium hydroxide, aluminum hydroxide, noncrystalline silica, fumed silica, synthetic silica, natural zeolite, synthetic zeolite, bentonite, activated clay, clay, talc, kaolin, mica, diatomite, or a combination thereof.

The insulator may include an amorphous phase, an amorphous phase including a partially crystalline phase, or a mixed phase thereof. The insulator may have desirable wetting properties, and the structure may be manufactured in a large area, e.g., manufactured to have a large surface area or large size.

The electrode layer 3 may be integrated with the electrically conductive layer 4. By using the integrated structure of the electrode layer 3 and the electrically conductive layer 4, the electrically conductive layer 4 may include a material having a composition having various electrical conductivities and the electrically conductive layer 4 may be formed relatively easier.

The electrode layer 3 may have a thickness of from about 5 μm to about 30 μm. The electrode layer 3 may have a thickness of, for example, from about 5 μm to about 25 μm, for example, from about 5 μm to about 20 μm, for example, from about 5 μm to about 15 μm, and for example, from about 5 μm to about 10 μm. When the electrode layer 3 has a thickness within these ranges, the electrode layer 3 may have an appropriate coefficient of thermal expansion CTE, and stress caused by, for example, thermal deformation may be reduced and the structure may be prepared relatively easily.

For example, the electrode layer 3 may be formed on the insulating layer 2 such that a positive electrode and a negative electrode are arranged in series or in parallel to be spaced apart from each other at a regular interval. Whether to increase and/or maintain a temperature of the electrically conductive layer 4 by adjusting a current flow between the electrodes may be based, for example, on the electrode layer 3. According to the arrangement of the electrode layer 3 on the insulating layer 2, a part of the electrically conductive layer 4 may be disposed at a region adjacent to the electrode layer 3 and/or on the upper surface of the insulating layer 2.

The electrode layer 3 may include a material of silver, gold, platinum, aluminum, copper, chromium, vanadium, magnesium, titanium, tin, lead, palladium, tungsten, nickel, an alloy thereof, an indium-tin oxide (ITO), a metal nanowire, a carbon nanostructure, or a combination thereof, without being limited thereto.

The electrically conductive layer 4 may be a conductive layer including a material that transmits an electrical signal. The electrically conductive layer 4 may include a material having excellent electrical conductivity and thermal conductivity. The electrically conductive layer 4 may be a heat generating layer having a heat generating function.

The electrically conductive layer 4 may be a film or sheet formed on the entire surface of the electrode layer 3. The electrically conductive layer 4 formed in the form of the film or sheet may have a wide contact surface with the electrode layer 3, electrical conductivity may be increased and heat may be uniformly generated, and a structure having a large area may be prepared. The electrically conductive layer 4 may be a single layer or multiple layers.

Examples of the material used to form the electrically conductive layer 4 may include porous carbon, conductive polymer, metal, metal oxide, metal nitride, or a combination thereof.

For example, the electrically conductive layer 4 may include a matrix and a plurality of conductive fillers. For example, the electrically conductive layer 4 may be a single-layer in which the matrix and the plurality of conductive fillers are mixed. The plurality of conductive fillers may be in direct contact with adjacent fillers in the horizontal or vertical direction and in surface contact with each other in at least one portion. In this way, the plurality of conductive fillers uniformly distributed in the matrix may be electrically connected with each other and the electrically conductive layer 4 may have a higher electrical conductivity. The electrically conductive layer 4 may be formed relatively easily.

An upper layer may further be disposed on the electrically conductive layer 4, if desired. The upper layer may be a single layer or multiple layers.

The matrix may include glass frit, an organic material, or a combination thereof.

The glass frit may have a composition and/or content, e.g., amounts of various components thereof, that is the same as or different from those of the insulator. For example, the glass frit may include silicon oxide ($SiO_2$), lithium oxide ($Li_2O$), nickel oxide (NiO), cobalt oxide (CoO), boron oxide ($B_2O_3$), potassium oxide ($K_2O$), aluminum oxide ($Al_2O_3$), titanium oxide ($TiO_2$), manganese oxide (MnO), copper oxide (CuO), zirconium oxide ($ZrO_2$), phosphorus oxide ($P_2O_5$), zinc oxide (ZnO), bismuth oxide ($Bi_2O_3$), lead oxide (PbO), barium oxide (BaO), strontium oxide (SrO), chromium oxide ($Cr_2O_3$), yttrium oxide ($Y_2O_3$), iron oxide ($Fe_2O_3$), magnesium oxide (MgO), sodium oxide ($Na_2O$), or a combination thereof. The glass frit may be a mixture of the oxide and an additive. The additive may include lithium (Li), nickel (Ni), cobalt (Co), boron (B), potassium (K), aluminum (Al), titanium (Ti), manganese (Mn), copper (Cu), zirconium (Zr), phosphorus (P), zinc (Zn), bismuth (Bi), lead (Pb), sodium (Na), or a combination thereof, without being limited thereto.

The organic material may include a polyimide, polyetherimide, polyphenylene sulfide, polyarylene ether sulfone, polybutylene terephthalate, polyamide, polyamideimide, polyarylene ether, liquid crystalline polymer, polyethylene terephthalate, polyether ketone, polyetherketone ketone, polyetherether ketone, or a combination thereof. The organic material may have a melting temperature $T_m$ of, for example, about 200° C. or higher, and the matrix may have desirable heat resistance.

The matrix may be in the form of particles. The matrix in particle form may have a surface functionalized with, for example, cations or anions. Examples of the cations may include ammonium silane-based monomers or oligomers. Examples of the anions may include hydroxide ion ($OH^-$), sulfate ion ($SO_4^{2-}$), sulfite ion ($SO_2^{2-}$), nitrate ion ($NO_3^-$), acetate ion ($CH_3COO^-$), permanganate ion ($MnO_4^-$), carbonate ion ($CO_3^{2-}$), sulfide ion ($S^{2-}$), chloride ion ($Cl^-$), bromide ion ($Br^-$), fluoride ion ($F^-$), oxide ion ($O^{2-}$), $COO^-$ ion, cyanate ion ($OCN^-$), tosylate ion (p-toluenesulfonic acid ($CH_3C_6H_4SO_3^-$)), or a combination thereof.

The plurality of conductive fillers may include nanomaterials. The plurality of conductive fillers may include nanosheets, nanoparticles, nanorods, nanowires, nanoplatelets, nanobelts, nanoribbons, or a combination thereof. The plurality of conductive fillers may be, for example, in the form of nanosheets, nanorods, or a combination thereof. The conductive fillers in the form of two-dimensional nanosheets, one-dimensional nanorods, or a combination thereof may form a conductive network in an interface between the matrices with a small amount. In the case of the nanosheets, adjacent nanosheets may be in surface contact with each other, and sinterability thereof may be improved. Due to, for example, the plurality of conductive filers, percolation of the electrically conductive layer 4 may improve, lower a sintering temperature thereof, and the electrically conductive layer 4 may have higher electrical conductivity compared to when using the same amount of commercial fillers.

The plurality of conductive fillers may have a composition having a minimum electrical conductivity or greater (e.g.: ≥10 S/m). For example, the plurality of conductive fillers may include a nanomaterial of an oxide, a boride, a carbide, a chalcogenide, or a combination thereof.

The oxide may include, for example, $RuO_2$, $MnO_2$, $ReO_2$, $VO_2$, $OsO_2$, $TaO_2$, $IrO_2$, $NbO_2$, $WO_2$, $GaO_2$, $MoO_2$, $InO_2$, $CrO_2$, $RhO_2$, or a combination thereof. For example, the oxide may include $RuO_2$, $MnO_2$, or a combination thereof. The boride may include, for example, $Ta_3B_4$, $Nb_3B_4$, TaB, NbB, $V_3B_4$, VB, or a combination thereof. The carbide may include, for example, $Dy_2C$, $Ho_2C$, or a combination thereof. The chalcogenide may include, for example, $AuTe_2$, $PdTe_2$, $PtTe_2$, $YTe_3$, $CuTe_2$, $NiTe_2$, $IrTe_2$, $PrTe_3$, $NdTe_3$, $SmTe_3$, $GdTe_3$, $TbTe_3$, $DyTe_3$, $HoTe_3$, $ErTe_3$, $CeTe_3$, $LaTe_3$, $TiSe_2$, $TiTe_2$, $ZrTe_2$, $HfTe_2$, $TaSe_2$, $TaTe_2$, $TiS_2$, $NbS_2$, $TaS_2$, $Hf_3Te_2$, $VSe_2$, $VTe_2$, $NbTe_2$, $LaTe_2$, $CeTe_2$, or a combination thereof.

A thickness of the plurality of conductive fillers may be from about 1 nanometer (nm) to about 1,000 nm. A length of the plurality of conductive fillers may be from about 0.1 μm to about 500 μm. When the thickness and the length of the plurality of conductive fillers are within these ranges, a conductive network may be formed in an interface between the matrices with a small amount.

An amount of the plurality of conductive fillers may be from about 0.1% by volume to about 99.99% by volume, based on 100% by volume of the electrically conductive layer 4. For example, the amount of the plurality of conductive fillers may be from about 0.1 to about 95% by volume, for example, from about 0.1 to about 30% by volume, for example, from about 0.1 to about 10% by volume, and for example, from about 0.1 to about 5% by volume, based on 100% by volume of the electrically conductive layer 4. Within these ranges, the plurality of conductive fillers may form a conductive network in an interface between the matrices.

The plurality of conductive fillers may include nanosheets and a medium between the nanosheets. The nanosheets may include oxide nanosheets, boride nanosheets, carbide nanosheets, chalcogenide nanosheets, or a combination thereof. Examples of the oxide nanosheets, boride nanosheets, carbide nanosheets, and chalcogenide nanosheets are given above, and detailed descriptions thereof will not be repeated. The medium may include particles of a noble metal, a transition metal, a rare-earth metal, or a combination thereof. The metal particles may have an average diameter D50 of from about 1 nm to about 10 μm. The "average diameter D50" refers a particle diameter corresponding to 50% from the smallest particle in a cumulative average particle diameter distribution graph, i.e., the total number of particles is 100%. The D50 may be measured by any suitable method, for example, using a particle size analyzer or a transmission electron microscopic (TEM) image or a scanning electron microscopic (SEM) image. Alternatively, the D50 may be also be obtained by measuring particle diameters with a measuring device using dynamic light-scattering, counting the number of particles within each particle size range via data analysis, and calculating the D50 therefrom.

The plurality of conductive fillers may further include a dispersion stabilizer, an oxidation-resistant stabilizer, a weather-resistant stabilizer, an antistatic agent, a dye, a pigment, a coupling agent, or a combination thereof. The dispersion stabilizer may include, for example, an amine-based low molecular weight compound, an amine-based oligomer, an amine-based polymer, or a combination thereof.

The electrically conductive layer 4 may further include an inorganic filler to improve heat resistance. Examples of the inorganic filler may include calcium carbonate, magnesium carbonate, calcium sulfate, magnesium sulfate, iron oxide, zinc oxide, magnesium oxide, aluminum oxide, calcium oxide, titanium oxide, calcium hydroxide, magnesium hydroxide, aluminum hydroxide, noncrystalline silica, fumed silica, synthetic silica, natural zeolite, synthetic zeolite, bentonite, activated clay, clay, talc, kaolin, mica, diatomite, or a combination thereof.

The electrically conductive layer 4 may include a carbon nanotube, an ionic liquid, and a binder, if desired. The electrically conductive layer 4 may further include a curing agent.

Examples of the carbon nanotube may include a single-walled carbon nanotube, a double-walled carbon nanotube, a multi-walled carbon nanotube, a rope carbon nanotube, or a combination thereof. The carbon nanotube may have effective heating characteristics when uniformly dispersed in the binder. An amount of the carbon nanotube may be from about 0.01 to about 300 parts by weight, for example, from about 1 to about 200 parts by weight, from about 10 to about 200 parts by weight, from about 20 to about 200 parts by weight, from about 20 to about 100 parts by weight, from about 30 to about 100 parts by weight, and from about 30 to about 75 parts by weight, based on 100 parts by weight of the binder and may be adjusted in accordance with characteristics of the electrically conductive layer, e.g. the heating element.

The ionic liquid may be used as a dispersant to not only adjust viscosity of the binder but also reduce viscosity increased by addition of the carbon nanotube. The ionic liquid may be any suitable ionic liquid that has compatibility with the binder and increases dispersibility of the carbon nanotube without limitation. In this regard, the term compatibility refers to the ability of preventing phase separation without delaying or stopping curing reaction. For example, the ionic liquid may be any suitable ionic liquid including a repeating unit having i) a cation of ammonium, pyrolidinium, pyridinium, pyrimidium, imidazolium, piperidinium, pyrazolium, oxazolium, pyridazinium, phosphonium, sulfonium, triazole, or a combination thereof; and ii) an anion of $BF_4^-$, $PF_6^-$, $AsF_6^-$, $SbF_6^-$, $AlCl_4^-$, $HSO_4^-$, $ClO_4^-$, $CH_3SO_3^-$, $CF_3CO_2^-$, $(CF_3SO_2)_2N^-$, $(FSO_2)_2N^-$, $Cl^-$, $Br^-$, $I^-$, $SO_4^-$, $CF_3SO_3^-$, $(C_2F_5SO_2)_2N^-$, $(C_2F_5SO_2)$, $(CF_2SO_2)N^-$, $NO_3^-$, $Al_2Cl_7^-$, $(CF_3SO_2)_3C^-$, $(CF_3)_2PF_4^-$, $(CF_3)_3PF_3^-$, $(CF_3)_4PF_2^-$, $(CF_3)_5PF^-$, $(CF_3)_6P^-$, $SF_5CF_2SO_3^-$, $SF_5CHFCF_2SO_3^-$, $CF_3CF_2(CF_3)_2CO^-$, $(CF_3SO_2)_2CH^-$, $(SF_5)_3C^-$, $(O(CF_3)_2C_2(CF_3)_2O)_2PO^-$, or a combination thereof. An amount of the ionic liquid may vary according to types of the carbon nanotube and the ionic liquid. The amount of the ionic liquid may be, for example, from about 1 to about 1,000 parts by weight, from about 10 to about 300 parts by weight, and from about 50 to about 200 parts by weight, based on 100 parts by weight of the carbon nanotube.

Examples of the binder may be natural rubber, synthetic rubber such as ethylene propylene diene monomer (EPDM) rubber, styrene butadiene rubber (SBR), butadiene rubber (BR), nitrile butadiene rubber (NBR), isoprene rubber, and polyisobutylene rubber, silicone rubber such as polydimethyl siloxane, fluorosilicone, or silicone-based resin, fluoroelastomer, or a combination thereof. For example, a two-component curing type silicone rubber may be used to obtain heat resistance and mechanical properties at a high temperature.

The electrically conductive layer 4 may have a thickness of from about 10 μm to about 50 μm. The electrically conductive layer 4 may have, for example, a thickness of from about 10 μm to about 40 μm and for example, from about 10 μm to about 30 μm. When the electrically conductive layer 4 has a thickness within these ranges, excellent heating effect and heating efficiency may be obtained. If desired, the electrically conductive layer 4 may have a pattern. The pattern may include a parallel pattern, a serial pattern, or a lattice pattern.

Examples of a method of forming the electrically conductive layer 4 may include chemical vapor deposition (CVD), sputtering, or spray coating.

A planar heater according to an embodiment includes the structure described above.

Figure 2A:
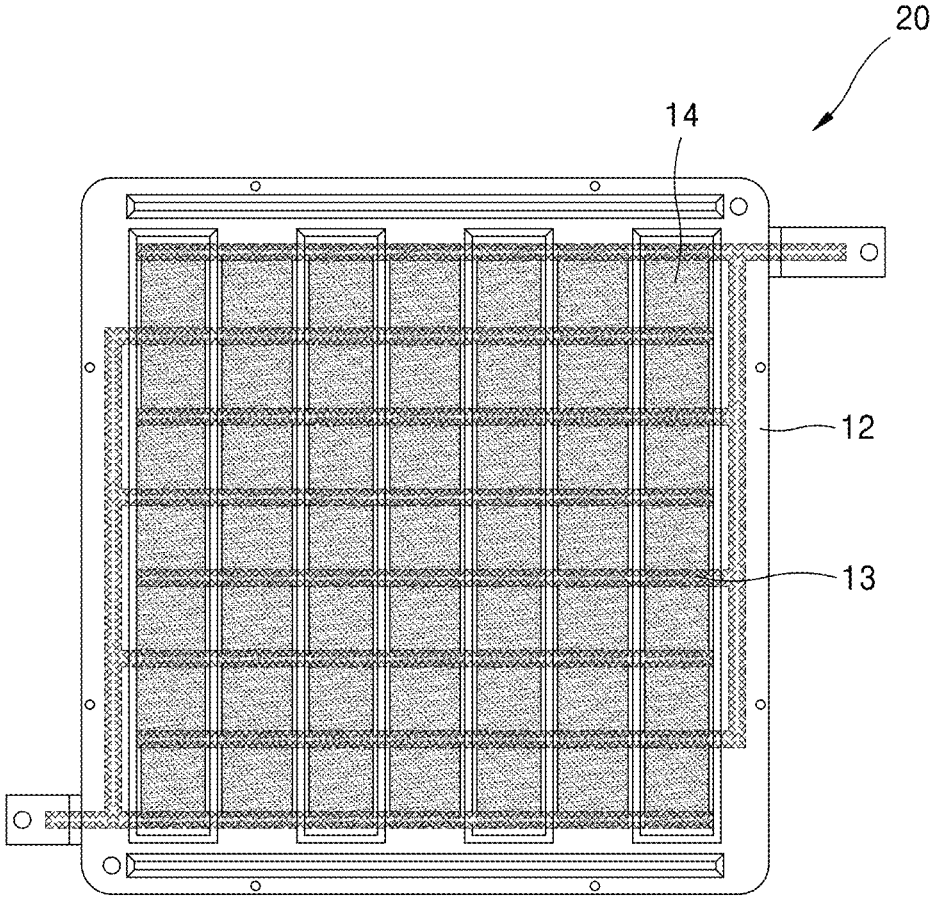
FIG. 2A is a schematic diagram of a planar heating plate including a structure according to an embodiment.

FIG. 2A is a schematic diagram of a planar heating plate 20 including the structure according to an embodiment.

Referring to FIG. 2A, the planar heating plate 20 includes the aforementioned structure in the form of plate, the structure including the substrate described above, an insulating layer 12 disposed on the substrate, an electrode layer 13 disposed on the insulating layer 12 and including a positive electrode and a negative electrode arranged in parallel to be spaced apart from each other at a regular interval (as indicated in FIG. 2A, e.g., a zigzag mark indicates that, the electrode layer 13 may be disposed under an electrically conductive layer 14), and the electrically conductive layer 14 disposed on the electrode layer 13. The planar heating plate 20 may be provided with joints disposed at a right upper end and a left lower end thereof.

Figure 2B:
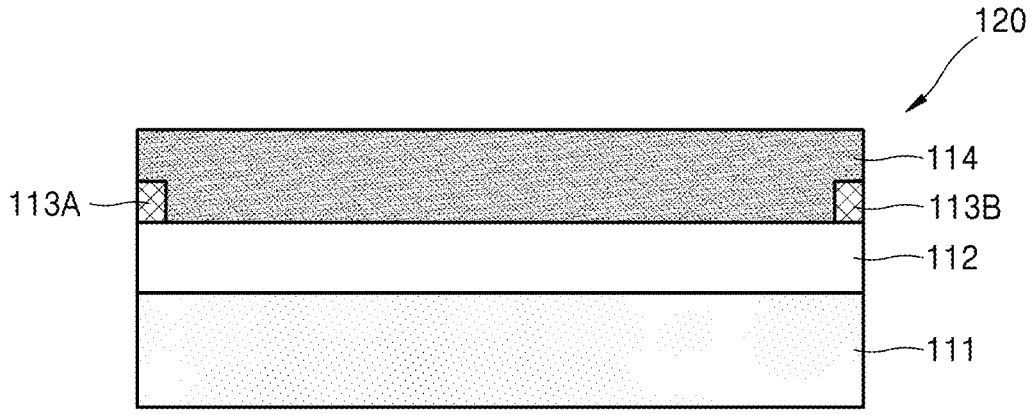
FIG. 2B is a schematic cross-sectional view of a structure viewed from the left side of the planar heating plate of FIG. 2A.

FIG. 2B is a schematic cross-sectional view of a structure 120 viewed from the left side of the planar heating plate 20 of FIG. 2A.

Referring to FIG. 2B, when viewed from the left side of the planar heating plate 20 of FIG. 2A, the structure 120 includes a substrate 111, an insulating layer 112 disposed on the substrate 111, electrode layers 113A and 113B disposed on the insulating layer 112 as a positive electrode and a negative electrode, and an electrically conductive layer 114 disposed on the electrode layers 113A and 113B and adjacent areas. That is, the electrode layers 113A and 113B are integrated with the electrically conductive layer 114.

Figure 2C:
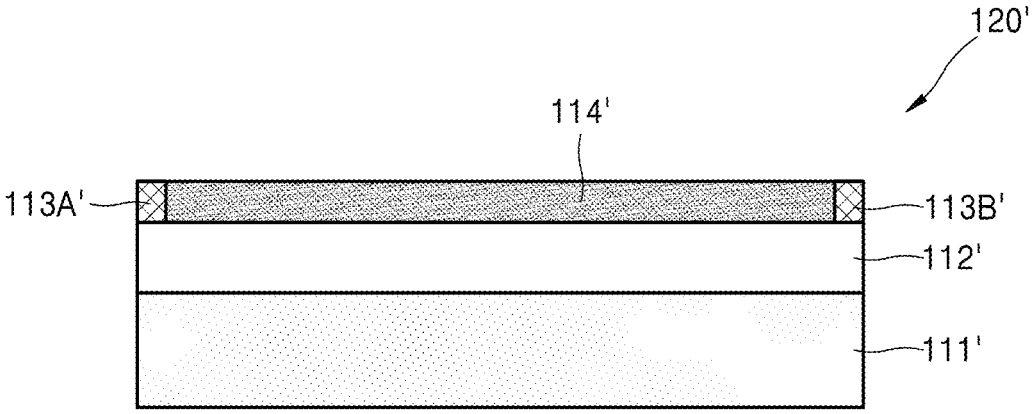
FIG. 2C is a schematic cross-sectional view of a structure viewed from the left side of the planar heating plate of FIG. 2A.

FIG. 2C is a schematic cross-sectional view of a structure 120' viewed from the left side of the planar heating plate 20 of FIG. 2A.

Referring to FIG. 2C, when viewed from the left side of the planar heating plate 20 of FIG. 2A, the structure 120' includes a substrate 111', an insulating layer 112' disposed on the substrate 111', electrode layers 113A' and 1136' disposed on the insulating layer 112' as a positive electrode and a negative electrode, and an electrically conductive layer 114' disposed adjacent to the electrode layers 113A' and 113B' and adjacent areas. That is, the electrode layers 113A' and 113B' and the electrically conductive layer 114' may share common surfaces on opposite sides thereof, e.g., the electrode layers 113A' and 113B' and the electrically conductive layer 114' may share a common surface on the insulating layer 112' and a common surface opposite the insulating layer 112'.

The planar heating plate 20 may have various structures in which the electrode layer 13 and/or the electrically conductive layer 14 are disposed on the insulating layer 12 in various patterns respectively according to purposes and uses thereof.

A heating device according to an embodiment may include the aforementioned planar heater.

Figure 3:
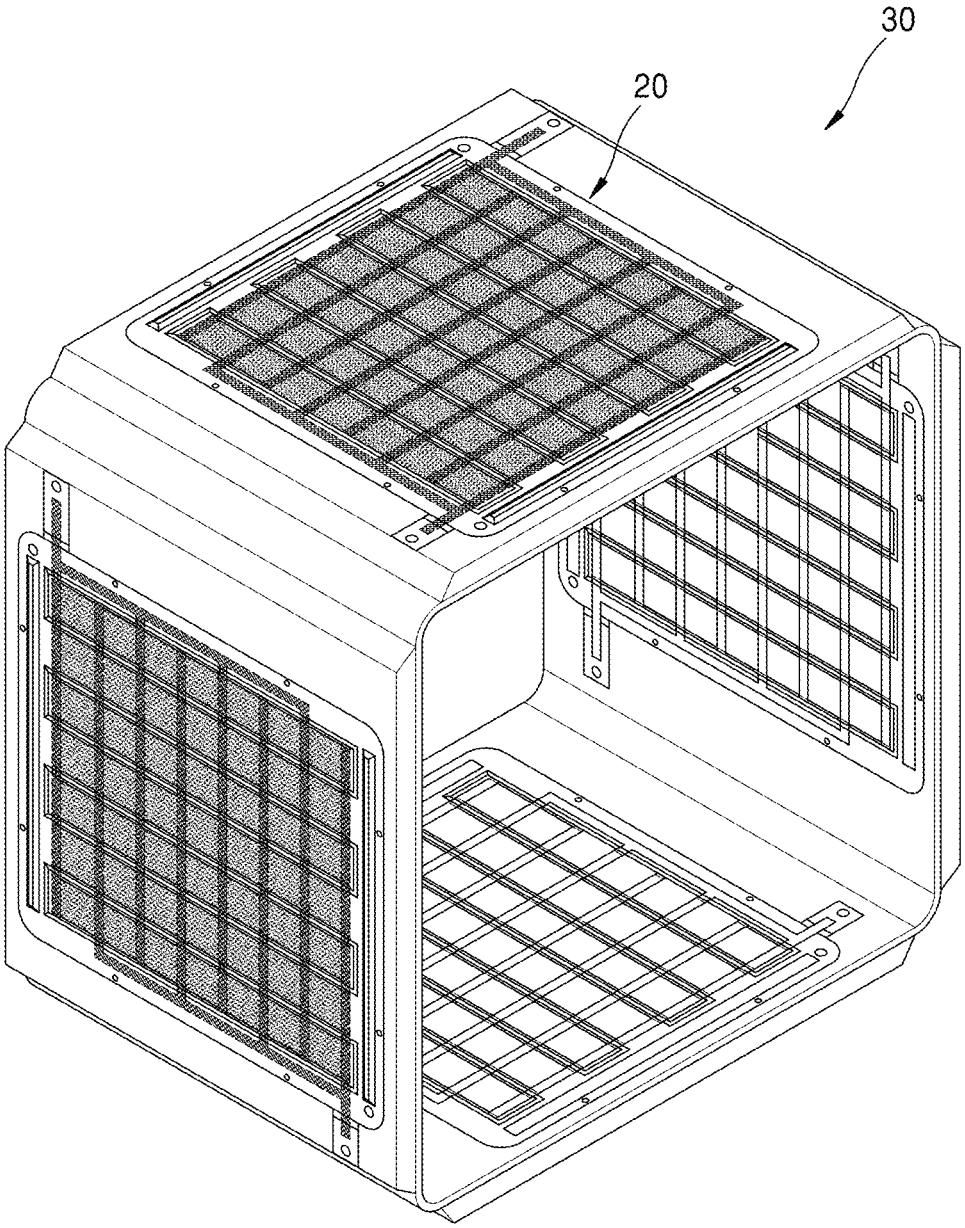
FIG. 3 is a schematic diagram illustrating a planar heating oven including the planar heating plate of FIG. 2A.

FIG. 3 is a schematic diagram illustrating a planar heating oven 30 including the planar heating plate 20 of FIG. 2A.

Referring to FIG. 3, the planar heating plates 20 of FIG. 2A are disposed on the surfaces of the planar heating oven 30 and coupled to each other using the joints. In the planar heating oven 30, temperature variation between the respective surfaces decreases to about 20° C. or less, heat is uniformly generated over the entire surface, and energy efficiency is improved. The temperature variation between the respective surfaces may be reduced by about 6 times or more when compared with commercial planar heating ovens. The planar heating oven 30 may have a heating rate faster than that of commercial planar heating ovens by about 20° C. via heating of the entire surface.

The aforementioned structure may also be applied to gas sensors, fuse assemblies, and thick film resistors in addition to the heating device.

Figure 4:
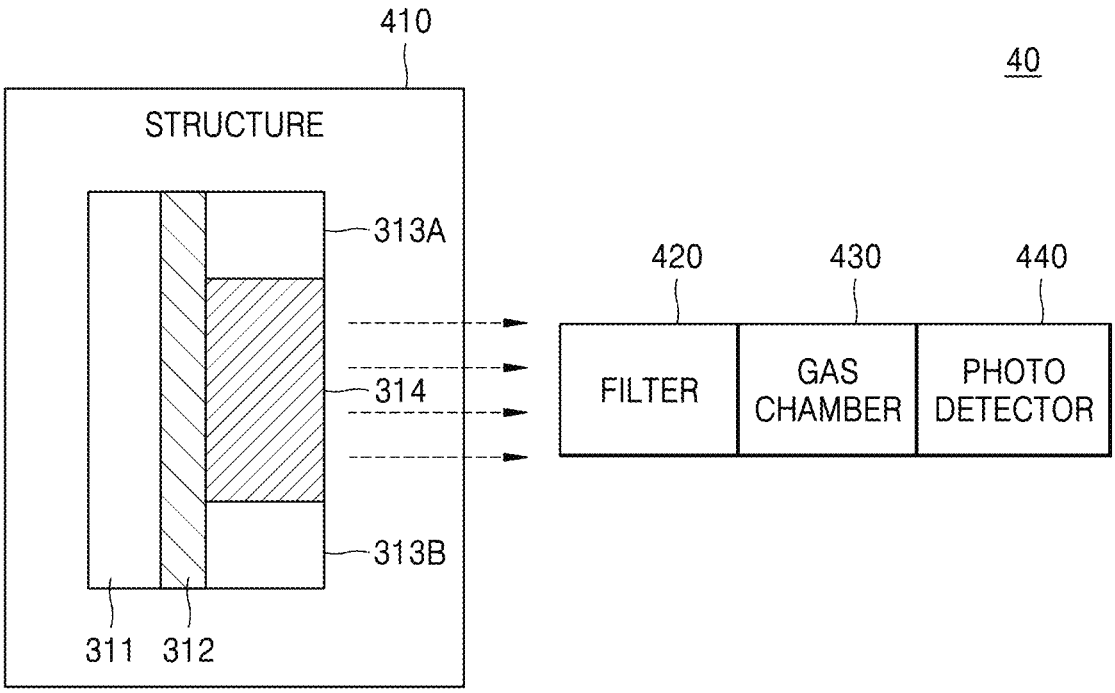
FIG. 4 is a schematic diagram of a gas sensor including a structure according to an embodiment.

FIG. 4 is a schematic diagram of a gas sensor 40 including a structure according to an embodiment.

The gas sensor 40 may be a gas sensor to detect gas by using light. As illustrated in FIG. 4, the gas sensor 40 may include a structure 410, a filter 420, a gas chamber 430, and a photodetector 440.

The structure 410 that emits particular light, e.g., infrared light, while generating heat may include a substrate 311, an insulating layer 312, electrode layers 313A and 313B, and an electrically conductive layer 314. Although the substrate 311 and the electrode layers 313A and 313B may be formed of the same materials as those of the substrate 1 and the electrode layer 3 illustrated in FIG. 1 respectively, the embodiment is not limited thereto.

The substrate 311 and the electrode layers 313A and 313B illustrated in FIG. 4 may be formed of materials suitable for the gas sensor 40. For example, the substrate 311 may be formed of a non-conductive material. For example, the substrate 311 may include silica glass, quartz glass, a polyimide, glass fibers, ceramics, or a combination thereof, and the electrode layers 313A and 313B may include an Ag—Pd alloy, molybdenum (Mo), tungsten (W), platinum (Pt), or a combination thereof.

The insulating layer 312 may be formed of the same material as that of the insulating layer 2 described above with reference to FIG. 1. For example, the insulating layer 312 may be formed of a material that may be relatively easily bonded to adjacent layers, for example, the substrate 311, the electrode layers 313A and 3138, and the electrically conductive layer 314 and may be able to withstand voltages, e.g., may not break down or lose insulating properties, at a high temperature.

The insulating layer 312 may include a glass frit with no or a small amount of an alkali metal oxide. For example, the insulating layer 312 may include about 2.2% by weight or less of an alkali metal oxide, based on a total weight of the insulating layer 312. The insulating layer 312 may have a glass transition temperature of about 500° C. or higher.

The electrically conductive layer 314 may include a material emitting light, e.g., infrared light by heating. For example, the electrically conductive layer 314 may include indium tin oxide (ITO), indium zinc oxide (IZO), zinc oxide (ZnO), tin oxide ($SnO_2$), antimony-doped tin oxide (ATO), Al-doped zinc oxide (AZO), gallium-doped zinc oxide (GZO), $TiO_2$, fluorine-doped tin oxide (FTO), or a combination thereof.

The filter 320 may selectively transmit light having a wavelength within a predetermined range among light radiated from the structure 410. The gas chamber 430 includes a gas inlet (not shown) through which gas is introduced from the outside and a gas outlet (not shown) through which gas is discharged and may be formed of a material transmitting light passing through the filter 320. The photodetector 440 detects light passing through the gas chamber 430. The photodetector 440 may detect an amount of gas contained in the gas chamber 430 based on the detected light. The structure according to an embodiment may also be applied to the gas sensor 40. Although a structure applied to gas sensors may generate heat by an electrical signal, the embodiment is not limited thereto. The structure applied to gas sensors may change in resistance by particle introduced from the outside, e.g., gas. A magnitude of an electrical signal received by an electrode may change by a change in resistance in response to gas introduction. The presence of gas, an amount of gas, and the like may be measured based on the received electrical signal.

The structure according to an embodiment may also be used in various applications in which insulating properties are desirable, such as, heaters for defrosting in refrigerators, heat exchangers, electric heating apparatuses, tempered glass, fuel cells, or sealing materials of solar cells.

The structure according to an embodiment may also be applied to devices or apparatuses that warm users. For example, the structure may be applied to hot packs, clothes (e.g., jackets and vests) worn by users, gloves, shoes, and the like. In this case, the structure may be provided inside the clothes.

The structure according to an embodiment may also be applied to wearable devices. The structure may be applied outdoor devices, e.g., devices generating heat in a cold environment.

The above-described insulating layer is not limited to the structure. The insulating layer may be applied to various apparatuses to prevent dielectric breakdown at a high temperature. The insulating layer according to an embodiment may be disposed on a functional layer performing predetermined functions by intrinsic electrical or optical properties by an external signal, such as, an electrical signal. In this regard, the electrical properties may refer to dielectric constant, dissipation factor, dielectric strength, resistivity, electrical conductivity, or the like and the optical properties may be expressed as reflectance, refractive index, or the like. The above-described electrically conductive layer may have high electrical conductivity as intrinsic electrical properties in addition to the function of transferring heat, and the electrically conductive layer may be an example of a functional layer generating heat by an electrical signal. The functional layer may be an endothermal layer, a refractive index-changing layer, or a reflectance-changing layer, in addition to a filler layer. That is, the insulating layer according to an embodiment may be applied to various devices by being disposed on a functional layer.

Figure 5:
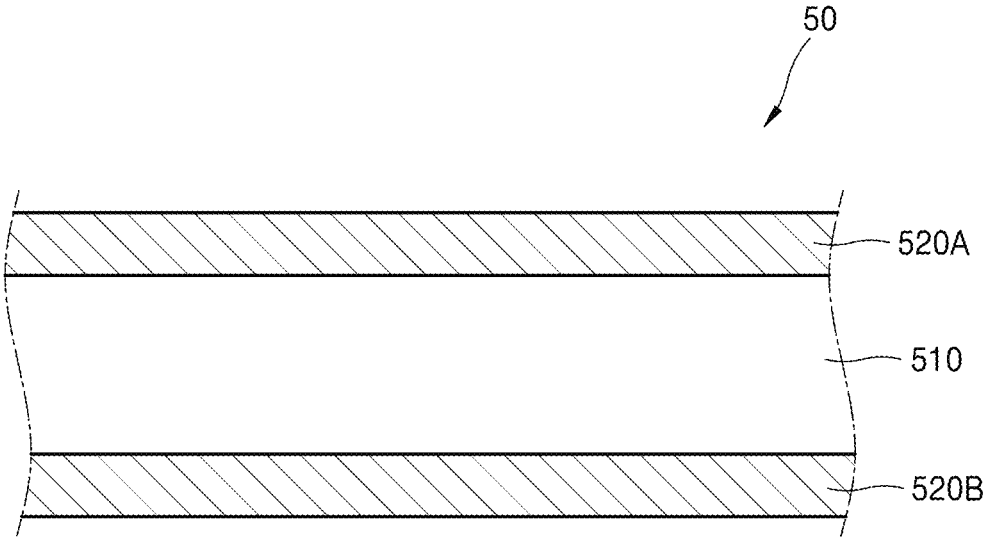
FIG. 5 is a diagram illustrating an embodiment of a substrate having insulating properties

The insulating layer according to an embodiment may also be applied to a substrate of an electronic device that is manufactured or operates at a high temperature. FIG. 5 is a diagram illustrating a substrate 50 having insulating properties. Substrate having high mechanical strength may be applicable to electronic devices. Conductive metal may have high mechanical strength. It may be difficult to design a circuit board on a metal substrate due to, for example, electrical conductivity of metal, and the substrate according to an embodiment may have insulating properties by locating, e.g., providing, an insulating layer on a base layer 510 that has electrical conductivity with high mechanical strength.

As illustrated in FIG. 5, the substrate 50 having insulating properties may include the base layer 510 formed of an electrically conductive material and insulating layers 520A and 520B electrically insulating the base layer 510. The insulating layers 520A and 520B may be disposed on both sides of the base layer 510, for example, on upper and lower surfaces of the base layer 510. The embodiment is not limited thereto and the insulating layers 520A and 520B may also be disposed on portions of the base layer 510.

Although the base layer 510 having electrical conductivity may be the same material as that of the substrate 1 illustrated in FIG. 1, the embodiment is not limited thereto.

The insulating layers 520A and 520B may be formed of the same material as that of the insulating layer 2 described above with reference to FIG. 1. For example, the insulating layers 520A and 520B may be formed of any suitable material that may be relatively easily bonded to the base layer 510 and that may be able to withstand voltages, e.g., may not break down or lose insulating properties, at a high temperature. The insulating layers 520A and 520B may include a glass frit with no or a small amount of an alkali metal oxide. For example, the insulating layers 520A and 520B may include about 2.2% by weight or less of an alkali metal oxide, based on a total weight of the insulating layers 520A and 520B. The insulating layers 520A and 520B may have a glass transition temperature of about 500° C. or higher.

The substrate 50 having the above-described insulating properties may be used as substrates of semiconductor devices, photovoltaic devices, and thin film solar cells, for example, in a flat panel. Shape and size of the substrate 50 may be appropriately determined in accordance with sizes of a semiconductor device, a light emitting device, an electronic circuit, a photovoltaic device, and a thin film solar cell in which the substrate 50 is used. When is used in a thin film solar cell, the substrate 50 may have a rectangular shape having one side greater than 1 meter (m).

A method of preparing the structure according to an embodiment may include: preparing a metal substrate; forming an insulating layer by coating an insulator composition on the metal substrate and heat-treating the composition; forming an electrode layer by coating an electrode layer forming composition on the insulating layer and heat-treating the composition; and forming an electrically conductive layer by coating an electrically conductive composition on the electrode layer and heat-treating the composition.

The metal substrate, the insulator composition, the electrode layer forming composition, and the electrically conductive composition are the same as those described above, and thus detailed descriptions thereof will not be repeated.

The coating of each operation may be performed by spray coating. By such a coating process, it may be relatively easy to form the coating. If desired, the coating may also be performed by any suitable methods such as spin coating, dip coating, roll coating, bar coating, extrusion, injection molding, compression molding (pressing), and calendering, as well as spray coating.

The heat-treating of each operation may be performed at a temperature of from about 600° C. to about 1,000° C. The compositions are sintered by the heat-treatment, and the metal substrate, the insulating layer, the electrode layer, and the electrically conductive layer may be formed in the form of film.

Hereinafter, one or more embodiments will be described in detail with reference to the following examples and comparative examples. However, these examples and comparative examples are not intended to limit the purpose and scope of the one or more embodiments.

EXAMPLES

Example 1

Preparation of Structure

A low carbon steel substrate (thickness: about 800 micrometers (μm)) was prepared. A glass frit insulator solution of a mixture satisfying Equation 1-1 below (glass frit: 69% by weight, water: 30% by weight, and clay: 1% by weight) was spray-coated on the low carbon steel substrate and heat-treated at 830° C. for 10 minutes to form an insulating layer (thickness: about 180 μm). An Ag solution was spray-coated on the insulating layer and heat-treated at 750° C. for 5 minutes to form an Ag electrode layer (thickness: about 10 μm). A complex aqueous solution of $RuO_2$ and a glass frit of a mixture satisfying Equation 1-1 (mixing ratio of $RuO_2$: glass frit=4:96), as an electrically conductive composition, was spray-coated on the Ag electrode layer and heat-treated at 800° C. for 5 minutes to form an electrically conductive layer (thickness: about 30 μm), thereby completing the preparation of a structure.

$$\text{INS}=a\text{BaO}+b\text{SiO}_2+c\text{Al}_2\text{O}_3+d\text{B}_2\text{O}_3+e\text{NiO}+f\text{CoO}+g(\text{SrO}, \text{Cr}_2\text{O}_3, \text{Y}_2\text{O}_3, \text{Fe}_2\text{O}_3, \text{MgO}, \text{TiO}_2, \text{ZrO}_2, \text{ or a combination thereof})+h(\text{Li}_2\text{O}, \text{Na}_2\text{O}, \text{K}_2\text{O}, \text{ or a combination thereof}) \quad \text{Equation 1-1}$$

In Equation 1-1,

INS represents a total weight of the glass frit insulator a is 34.50% by weight;

b is 19.90% by weight;

c is 0.80% by weight;

d is 14.90% by weight;

e is 0.20% by weight;

f is 1.60% by weight;

g is 27.75% by weight;

h is 0.35% by weight; and a+b+c+d+e+f+g+h is equal to 100% by weight.

Amounts of the components included in the brackets may be identified by inductively coupled plasma (ICP) analysis which will be described later.

Example 2

Preparation of Structure

A structure was prepared in the same manner as in Example 1, except that the coefficient h was 0.31% by weight instead of 0.35% by weight in Equation 1-1 in the glass frit insulator solution of the mixture satisfying Equation 1-1.

Example 3

Preparation of Structure

A structure was prepared in the same manner as in Example 1, except that the a/b ratio was 1.45 instead of 1.73 in the glass frit insulator solution of the mixture satisfying Equation 1-1.

Example 4

Preparation of Structure

A structure was prepared in the same manner as in Example 1, except that the a/b ratio was 1.80 instead of 1.73 in the glass frit insulator solution of the mixture satisfying Equation 1-1.

Example 5

Preparation of Structure

A structure was prepared in the same manner as in Example 1, except that the a/b ratio was 2.08 instead of 1.73 in the glass frit insulator solution of the mixture satisfying Equation 1-1.

Comparative Example 1

Preparation of Structure

A structure was prepared in the same manner as in Example 1, except that an insulating layer (thickness: about 180 μm) was formed by spray-coating an enamel frit insulator solution (Hae Kwang Enamel Industrial Co., Ltd., 11.26% by weight of a combination of ground coat enamel, the $Li_2O$ component, the $Na_2O$ component, and the $K_2O$ component) on the low carbon steel substrate and heat-treating the coating at 830° C. for 10 minutes instead of forming the insulating layer (thickness: about 180 μm) by spray-coating the glass frit insulator solution of the mixture satisfying Equation 1-1 on the low carbon steel substrate and heat-treating the coating at 830° C. for 10 minutes.

Comparative Example 2

Preparation of Structure

A structure was prepared in the same manner as in Example 1, except that an insulating layer (thickness: about 180 μm) was formed by spray-coating an enamel frit insulator solution (KPM, 6.46% by weight of a combination of SPL-2, the $Li_2O$ component, the $Na_2O$ component, and the $K_2O$ component) on the low carbon steel substrate and heat-treating the coating at 830° C. for 10 minutes instead of forming the insulating layer (thickness: about 180 μm) by spray-coating the glass frit insulator solution of the mixture satisfying Equation 1-1 on the low carbon steel substrate and heat-treating the coating at 830° C. for 10 minutes.

Reference Example 1

Preparation of Structure

A structure including an insulating layer (thickness: about 180 μm) prepared by spray-coating a glass frit insulator solution of the mixture satisfying Equation 1-1 according to Example 1 on an iron (Fe) substrate (thickness: about 800 μm) and heat-treating the coating at 830° C. for 10 minutes was prepared.

Comparative Reference Example 1

Preparation of Structure

A structure including an insulating layer (thickness: about 180 μm) prepared by spray-coating a glass frit insulator solution (SCHOTT, including G018-311 without using the NiO component and the CoO component) on an iron (Fe) substrate (thickness: about 800 μm) and heat-treating the coating at 830° C. for 10 minutes was prepared.

Comparative Reference Example 2

Preparation of Structure

A structure including an insulating layer (thickness: about 180 μm) prepared by spray-coating a glass frit insulator solution (satisfying Equation 1-1 including 0.8% by weight of the CoO component without using the NiO component) on an iron (Fe) substrate (thickness: about 800 μm) and heat-treating the coating at 830° C. for 10 minutes was prepared.

Analysis Example 1

Analysis of Composition of Insulator

The composition of the insulator included in the insulating layer of the structure prepared according to Example 1 was subjected to ICP analysis. The ICP analysis was performed using an ICPS-8100 (RF source: 27.12 MHz, sample uptake rate: 0.8 ml/min) as an inductively coupled plasma—atomic emission spectrometer (ICP-AES) manufactured by Shimadzu Corp. The results are shown in Table 1 below.

TABLE 1

| Insulator Component | Content (weight %) |
|---|---|
| BaO | 34.50 |
| $SiO_2$ | 19.90 |
| $Al_2O_3$ | 0.80 |
| $B_2O_3$ | 14.90 |
| NiO | 0.20 |
| CoO | 1.60 |
| SrO | 2.90 |
| $Cr_2O_3$ | 0 |
| $Y_2O_3$ | 0.02 |
| $Fe_2O_3$ | 0 |
| MgO | 11.72 |
| $TiO_2$ | 5.435 |
| $ZrO_2$ | 7.675 |
| $Li_2O$ | 0 |
| $Na_2O$ | 0.35 |
| $K_2O$ | 0 |

Referring to Table 1, the composition of the insulator included in the insulating layer of the structure prepared according to Example 1 was identical to the composition of the glass frit insulator of the mixture satisfying Equation 1-1.

Evaluation Example 1

Evaluation of Temperature at Thermal Breakdown

Electrode layers were formed on the insulating layers of the structures prepared according to Examples 1 and 2 and Comparative Examples 1 and 2 by screen printing. An Ag-glass slurry (Daejoo Electronic Materials Co., Ltd., DS-PF-7180TR) was coated on the surfaces of the insulating layers and heat-treated at 750° C. for 10 minutes to form the electrode layers and the electrode layers were connected to a power source. Then, a voltage of 250 V was applied to the structures including the insulating layers on which the electrode layers are formed while heating the structures in a high temperature electrical furnace (box furnace) to measure temperatures at which thermal breakdown occurs. The results are shown in FIG. 6.

Figure 6:
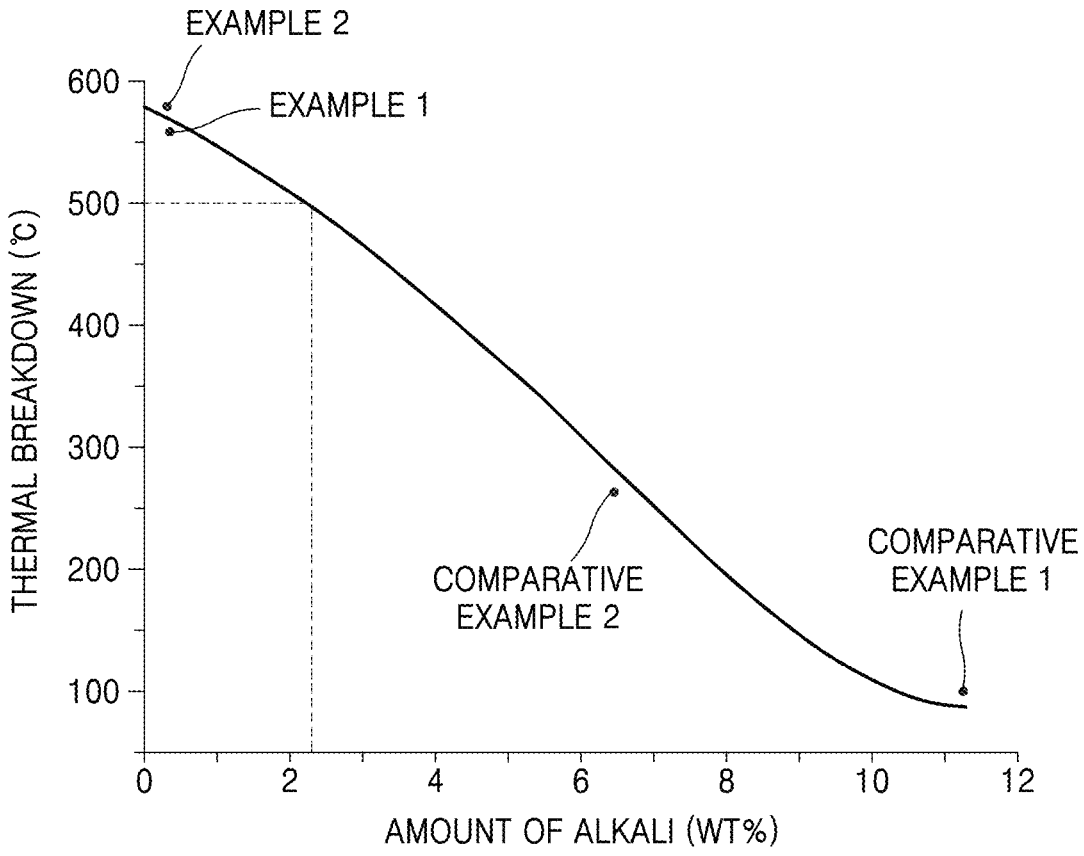
FIG. 6 is a graph illustrating temperature at which thermal breakdown occurs with respect to alkali content (i.e., h of Equation 1 and $h_1$ of Equation 1a) of insulators included in insulating layers of structures prepared according to Examples 1 and 2 and Comparative Examples 1 and 2.

Referring to FIG. 6, thermal breakdown occurred at 560° C. and 580° C. in the insulating layers of the structures prepared according to Examples 1 and 2 respectively and at 100° C. and 265° C. in the insulating layers of the structures prepared according to Comparative Examples 1 and 2 respectively.

Accordingly, it was confirmed that the insulating layers of the structures prepared according to Examples 1 and 2 are stable at a high temperature of 500° C. or higher.

Evaluation Example 2

Evaluation of Coefficient of Thermal Expansion (CTE)

The insulating layers of the structures prepared according to Examples 1, 3, 4, and 5 were evaluated in a nitrogen atmosphere using a thermomechanical analyzer (NETZSCH, TMA 402 F1). Temperature was increased under the following conditions. In a first operation, the structures were heated to 150° C. at a heating rate of 10° C./min to remove moisture therefrom. In a second operation, the structures were cooled to room temperature at a cooling rate of 5° C./min. In a third operation, the coefficient of thermal expansion CTE was measured at a heating rate of 10° C./min over a temperature range of 25° C. to 600° C. The results are shown in FIG. 7.

Figure 7:
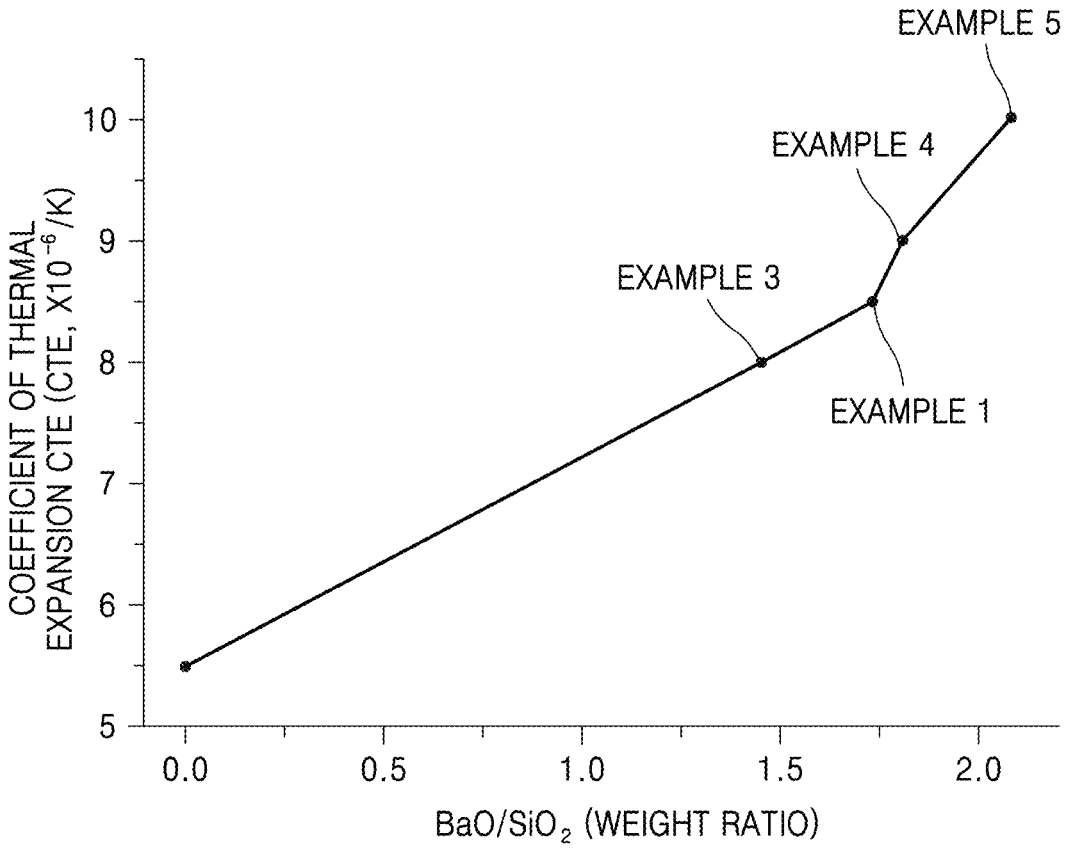
FIG. 7 is a graph illustrating coefficient of thermal expansion CTE with respect to $BaO/SiO_2$ weight ratio (i.e., a/b in Equation 1 or $a_1/b_1$ in Equation 1a) of insulators included in insulating layers of structures prepared according to Examples 1, 3, 4, and 5.

Referring to FIG. 7, coefficients of thermal expansion CTE of the insulating layers of the structures prepared according to Examples 1, 3, 4, and 5 were 8.5 ppm/K, 8 ppm/K, 9 ppm/K, and 10 ppm/K respectively. In this case, coefficients of thermal expansion CTE of the low carbon steel substrates included in the structures prepared according to Examples 1, 3, 4, and 5 were about 12 ppm/K.

It was confirmed that a difference in the coefficient of thermal expansion CTE between the low carbon steel substrate and the insulating layer was less than 4 ppm/K in the structures prepared according to Examples 1, 3, 4, and 5.

Evaluation Example 3

Forward Looking Infrared (FLIR) Image

The glass frit insulator solution of Example 1, the enamel frit insulator solution of Comparative Example 1, and the enamel frit insulator solution of Comparative Example 2 were coated on an iron (Fe) substrate by spray coating and heat-treated at 830° C. for 10 minutes to form insulating layers (thickness: about 180 μm) respectively. Electrode layers were formed on the insulating layers by screen printing respectively. The electrode layers were prepared by patterning an Ag-glass slurry (Daejoo Electronic Materials Co., Ltd., DS-PF-7180TR) using a substrate for screen printing and heat-treating the patterns at 750° C. for 10 minutes. Then, a complex aqueous solution of $RuO_2$ and a glass frit of the mixture satisfying Equation 1-1 (mixing ratio of $RuO_2$:glass frit=4:96), as an electrically conductive composition, was spray-coated on the Ag electrode layers and heat-treated at 800° C. for 5 minutes to form electrically conductive layers (thickness: about 30 μm), thereby completing the preparation of planar heating plates including the structures respectively.

The planar heating plate including the structure having the insulating layer formed using the enamel frit insulator solution according to Comparative Example 2 was connected to a power source and heated to 400° C. at a heating rate of 40° C./min, and then photographed using a camera (Samsung electronics, NX-10). The planar heating plates respectively including the structures prepared according to Example 1 and Comparative Example 2 were connected to the power source and heated respectively to 510° C. and 270° C. at a heating rate of 40° C./min and then photographed using a FLIR Systems (FLIR SC620). The results are shown in FIGS. 8, 9A, and 9B, respectively.

Figure 8:
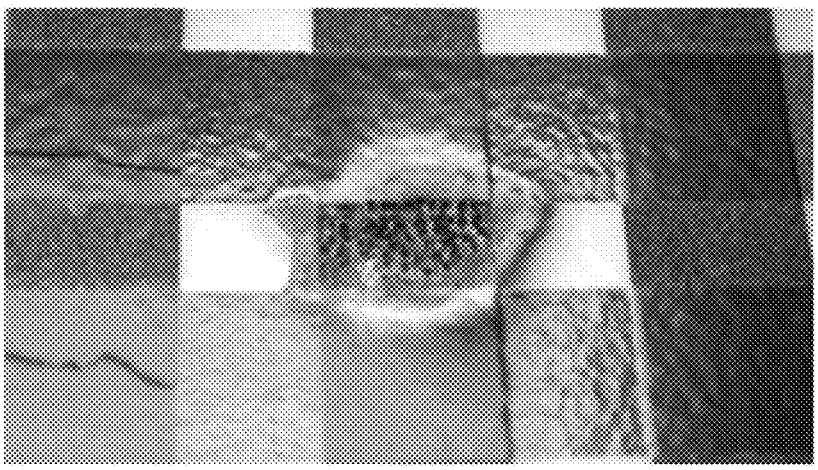
FIG. 8 is a photograph of a planar heating plate including an insulating layer formed on an iron (Fe) substrate by using an enamel frit insulator solution prepared according to Comparative Example 2 after heating to 400° C.
Figure 9A:
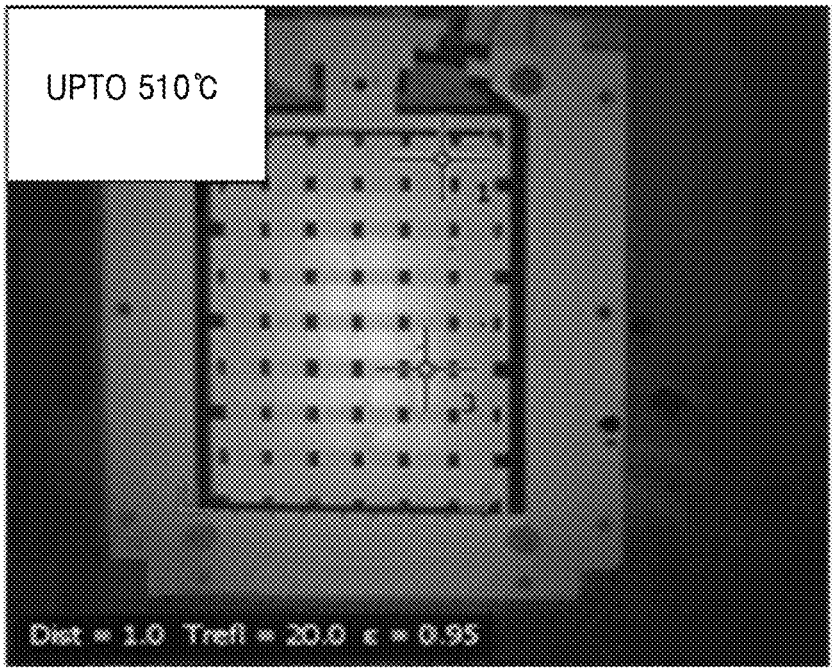
FIG. 9A is a photograph of a planar heating plate including a structure including an insulating layer formed on an iron (Fe) substrate by using a glass frit insulator solution prepared according to Example 1, the photograph obtained using a forward looking infrared (FLIR) camera after heating to 510° C.
Figure 9B:
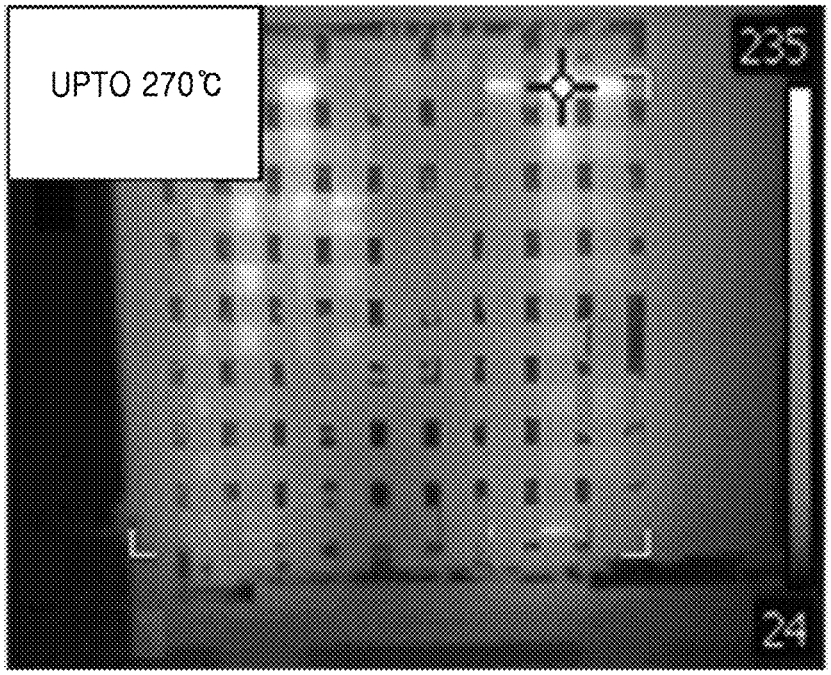
FIG. 9B is a photograph of a planar heating plate including a structure including an insulating layer formed on an iron (Fe) substrate by using an enamel frit insulator solution prepared according to Comparative Example 1, the photograph obtained using an FLIR camera after heating to 270° C.

Referring to FIG. 8, a thermal breakdown phenomenon occurred in the planar heating plate including the structure having the insulating layer formed using the enamel frit insulator solution of Comparative Example 2 after heating the planar heating plate to 400° C. Referring to FIGS. 9A and 9B, the entire planar heating plate including the structure having the insulating layer formed using the glass frit insulator solution of Example 1 uniformly generated heat at a temperature of 510° C. A part of the heating plate including the structure having the insulating layer formed using the enamel frit insulator solution of Comparative Example 2 did not generate heat when the planar heating plate was heated to 270° C.

Evaluation Example 4

Evaluation of Adhesive Force of Insulating Layer

The structures prepared according to Comparative Reference Example 1, Comparative Reference Example 2, and Reference Example 1 were subjected to an adhesive force test between the low carbon steel substrate and the insulating layer by dropping a 2 kilogram (kg) steel use stainless (SUS) ball at 30 centimeters (cm) from the structures. The results were shown in FIGS. 10A, 10B, and 10C, respectively. In this case, states and levels for the reference of adhesive force evaluation are shown at right upper portions or FIGS. 10A, 10B, and 10C, respectively. The states are shown on the left and the levels are shown on the right to evaluate the adhesive force. Levels 2 and 3 represent pass and levels 4 and 5 represent fail.

Figure 10A:
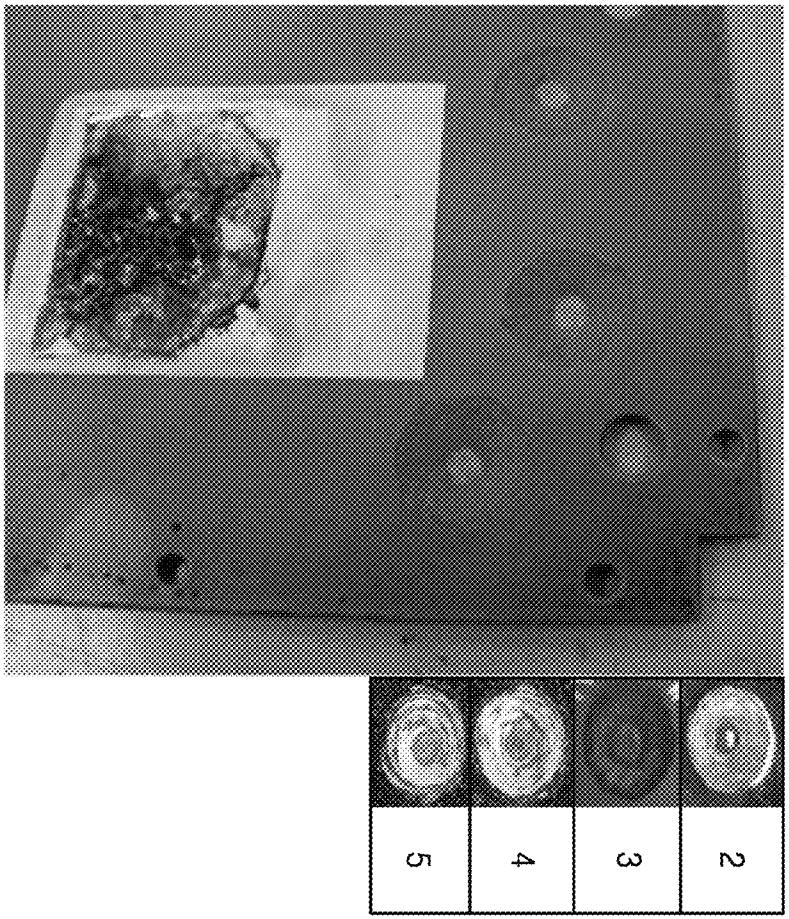
FIGS. 10A, 10B, and 10C are photographs of structures prepared according to Comparative Reference Example 1, Comparative Reference Example 2, and Reference Example 1 after dropping a 2 kilogram (kg) steel use stainless (SUS) ball at 30 centimeters (cm) from the structures, respectively.
Figure 10B:
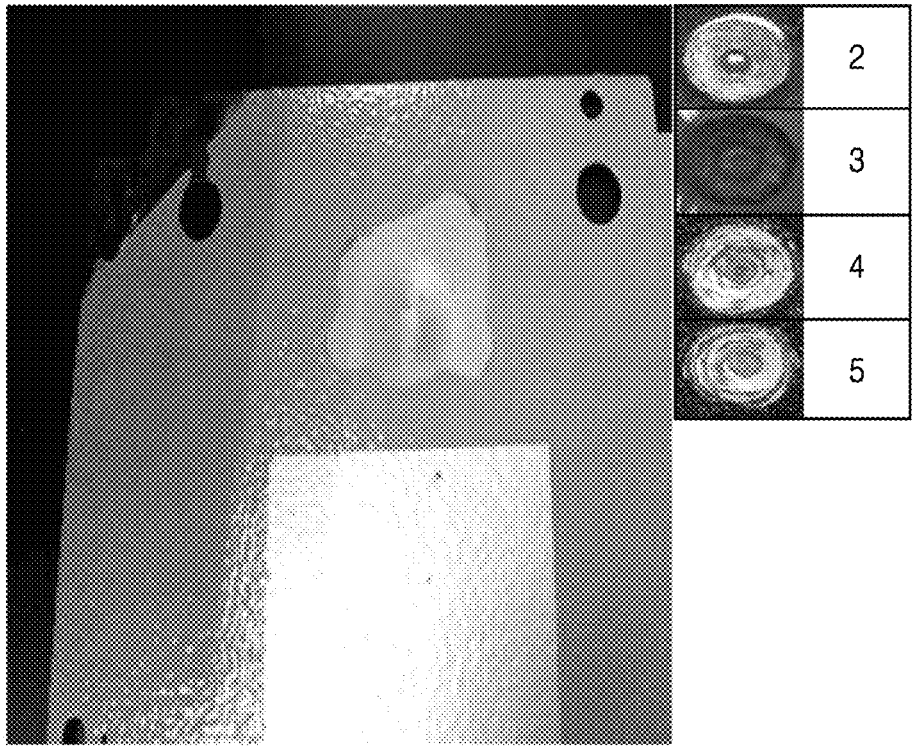
Figure 10C:
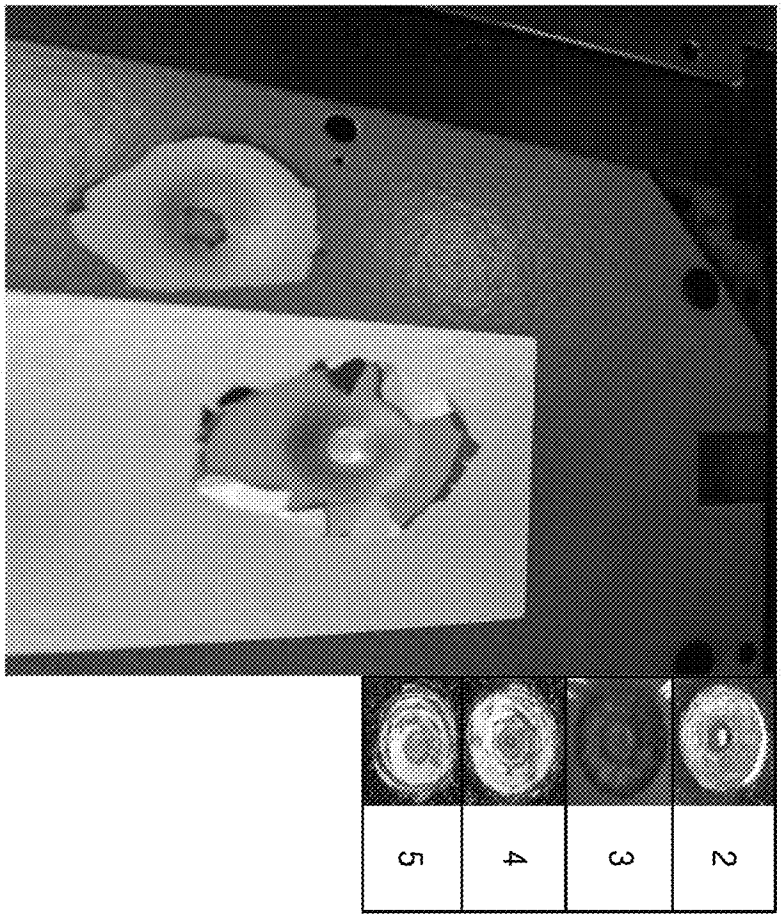

Referring to FIGS. 10A and 10B, the structures prepared according to Comparative Reference Examples 1 and 2 were level 5 indicating fail. Referring to FIG. 10C, the structure prepared according to Reference Example 1 was level 2 indicating pass.

It was confirmed that the structure prepared according to Reference Example 1 has a strong adhesive force between the low carbon steel structure and the insulating layer.

As is apparent from the above description, according to the structure including a metal substrate, an insulating layer disposed on the metal substrate, an electrode layer disposed on the insulating layer, and an electrically conductive layer disposed on the electrode layer with a difference in coefficient of thermal expansion CTE between the metal substrate and the insulating layer of about 4 ppm/K or less, insulating properties may be obtained at a high temperature (500° C. or higher) and a desirable adhesive force may be obtained between the substrate and the insulating layer.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A structure comprising:

a metal substrate;

an insulating layer disposed on the metal substrate;

an electrode layer disposed on the insulating layer; and an electrically conductive layer disposed on the electrode layer, wherein a difference in a coefficient of thermal expansion between the metal substrate and the insulating layer is about 4 parts per million per degree Kelvin change in temperature or less, and the insulator is a mixture satisfying Equation 1:

$$INS=aBaO+bSiO_2+cAl_2O_3+dB_2O_3+eNiO+fCoO+g(SrO, Cr_2O_3, Y_2O_3, Fe_2O_3, MgO, TiO_2, ZrO_2, \text{or a combination thereof})+h(Li_2O, Na_2O, K_2O, \text{or a combination thereof}) \quad \text{Equation 1}$$

wherein in Equation 1,

INS is a total weight of the insulator $1.0 \le a/b \le 5.0$;

0.1% by weight$\le e \le$3.0% by weight;

0.1% by weight$\le f \le$3.0% by weight;

0.1% by weight$\le g \le$30% by weight;

0.1% by weight$\le h \le$2.2% by weight;

a+b+c+d+e+f+g+h is equal to 100% by weight; and c+d is equal to 100−a−b−e−f−g−h.

2. The structure of claim 1, wherein the insulating layer is on an entire surface of the metal substrate.

3. The structure of claim 1, wherein the insulating layer has a thickness of from about 100 micrometers to about 300 micrometers.

4. The structure of claim 1, wherein $1.3 \le a/b \le 2.3$ in Equation 1.

5. The structure of claim 1, wherein 0.1% by weight$\le h \le$2.0% by weight in Equation 1.

6. The structure of claim 1, wherein 0.1% by weight$\le c \le$10.0% by weight in Equation 1.

7. The structure of claim 1, wherein 0.1% by weight$\le d \le$20.0% by weight in Equation 1.

8. The structure of claim 1, wherein the insulator is a mixture satisfying Equation la: Equation 1a:

$$INS_1=a_1BaO+b_1SiO_2+c_1Al_2O_3+d_1B_2O_3+e_1NiO+f_1CoO+g_1(SrO, Cr_2O_3, Y_2O_3, Fe_2O_3, MgO, TiO_2, ZrO_2, \text{or a combination thereof})+h_1(Li_2O, Na_2O, K_2O, \text{or a combination thereof})+i_1(CaO, ZnO, \text{or a combination thereof}) \quad \text{Equation 1a}$$

wherein in Equation 1a, $INS_1$ is a total weight of the insulator;

$1.0 \le a_1/b_1 \le 5.0$;

0.1% by weight$\le e_1 \le$3.0% by weight;

0.1% by weight$\le f_1 \le$3.0% by weight;

0.1% by weight$\le g_1 \le$30.0% by weight;

0.1% by weight$\le h_1 \le$2.2% by weight;

0.1% by weight$\le i_1 \le$5.0% by weight;

$a_1+b_1+c_1+d_1+e_1+f_1+g_1+h_1+i_1$ is equal to 100% by weight; and $c_1+d_1$ is equal to $100-a_1-b_1-e_1-f_1-g_1-h_1-i_1$.

9. The structure of claim 1, wherein:

the insulating layer comprises an insulator; and the insulator comprises an amorphous phase, the amorphous phase comprising a partially crystalline phase, or a mixed phase thereof.

10. The structure of claim 1, wherein the electrode layer has a thickness of from about 5 micrometers to about 30 micrometers.

11. The structure of claim 1, wherein the electrically conductive layer is a heat generating layer.

12. The structure of claim 11, wherein the electrically conductive layer comprises a matrix and a plurality of conductive fillers.

13. The structure of claim 12, wherein the matrix comprises a glass frit, an organic material, or a combination thereof.

14. The structure of claim 13, wherein the matrix comprises the glass frit, and the glass frit comprises silicon oxide, lithium oxide, nickel oxide, cobalt oxide, boron oxide, potassium oxide, aluminum oxide, titanium oxide, manganese oxide, copper oxide, zirconium oxide, phosphorus oxide, zinc oxide, bismuth oxide, lead oxide, barium oxide, strontium oxide, chromium oxide, yttrium oxide, iron oxide, magnesium oxide, sodium oxide, or a combination thereof.

15. The structure of claim 13, wherein the matrix comprises the organic material, and the organic material comprises a polyimide, polyetherimide, polyphenylene sulfide, polyarylene ether sulfone, polybutylene terephthalate, polyamide, polyamideimide, polyarylene ether, liquid crystalline polymer, polyethylene terephthalate, polyether ketone, polyetherketone ketone, polyetherether ketone, or a combination thereof.

16. The structure of claim 12, wherein the plurality of conductive fillers comprises a nanomaterial.

17. The structure of claim 12, wherein the plurality of conductive fillers comprises nanosheets, nanoparticles, nanorods, nanowires, nanoplatelets, nanobelts, nanoribbons, or a combination thereof.

18. The structure of claim 12, wherein the plurality of conductive fillers comprises an oxide, a boride, a carbide, a chalcogenide, or a combination thereof.

19. The structure of claim 18, wherein the plurality of conductive fillers comprises the oxide, and the oxide comprises $RuO_2$, $MnO_2$, $ReO_2$, $VO_2$, $OsO_2$, $TaO_2$, $IrO_2$, $NbO_2$, $WO_2$, $GaO_2$, $MoO_2$, $InO_2$, $CrO_2$, $RhO_2$, or a combination thereof.

20. The structure of claim 18, wherein the plurality of conductive fillers comprises the boride, and the boride comprises $Ta_3B_4$, $Nb_3B_4$, TaB, NbB, $V_3B_4$, VB, or a combination thereof.

21. The structure of claim 18, wherein the plurality of conductive fillers comprises the carbide, and the carbide comprises $Dy_2C$, $Ho_2C$, or a combination thereof.

22. The structure of claim 18, wherein the plurality of conductive fillers comprises the chalcogenide, and the chalcogenide comprises $AuTe_2$, $PdTe_2$, $PtTe_2$, $YTe_3$, $CuTe_2$, $NiTe_2$, $IrTe_2$, $PrTe_3$, $NdTe_3$, $SmTe_3$, $GdTe_3$, $TbTe_3$, $DyTe_3$, $HoTe_3$, $ErTe_3$, $CeTe_3$, $LaTe_3$, $TiSe_2$, $TiTe_2$, $ZrTe_2$, $HfTe_2$, $TaSe_2$, $TaTe_2$, $TiS_2$, $NbS_2$, $TaS_2$, $Hf_3Te_2$, $VSe_2$, $VTe_2$, $NbTe_2$, $LaTe_2$, $CeTe_2$, or a combination thereof.

23. The structure of claim 12, wherein an amount of the plurality of conductive fillers is about 0.1% by volume to about 99.99% by volume, based on 100% by volume of the electrically conductive layer.

24. The structure of claim 12, wherein the plurality of conductive fillers comprises nanosheets and a medium between the nanosheets.

25. The structure of claim 24, wherein the nanosheets comprise oxide nanosheets, boride nanosheets, carbide nanosheets, chalcogenide nanosheets, or a combination thereof.

26. The structure of claim 24, wherein the medium comprises a noble metal, a transition metal, a rare-earth metal, or a combination thereof.

27. The structure of claim 1, wherein the electrically conductive layer is a film or sheet and is on an entire surface of the electrode layer.

28. The structure of claim 26, wherein the metal particles have an average diameter D50 of about 1 nanometer to about 10 micrometers.

29. The structure of claim 1, wherein the electrically conductive layer has a thickness of about 10 micrometers to about 50 micrometers.

30. A planar heater comprising the structure according to claim 1.

31. A heating device comprising the planar heater of claim 30.

32. A method of preparing the structure according to claim 1, the method comprising:

preparing the metal substrate;

forming the insulating layer on the metal substrate by coating an insulator composition on the metal substrate and heat-treating the insulator composition;

forming the electrode layer on the insulating layer by coating an electrode layer forming composition on the insulating layer and heat-treating the electrode layer forming composition; and forming the electrically conductive layer on the electrode layer by coating an electrically conductive composition on the electrode layer and heat-treating the electrically conductive composition.

33. The method of claim 32, wherein the coating of each of the insulator composition, the electrode layer forming composition, and the electrically conductive composition is performed by spray coating.

34. The method of claim 32, wherein the heat-treating of each of the insulator composition, the electrode layer forming composition, and the electrically conductive composition is performed at a temperature of about 600° C. to about 1,000° C.

35. A structure comprising:

a metal substrate, wherein the metal substrate has a coefficient of thermal expansion of about 11 to about 13 parts per million per degree Kelvin change in temperature;

an insulating layer disposed on the metal substrate, wherein the insulating layer comprises a mixture satisfying Equation 1b:

$$INS_2 = aBaO + bSiO_2 + cAl_2O_3 + dB_2O_3 + eNiO + fCoO + g(SrO, Y_2O_3, MgO, TiO_2, ZrO_2) + h(Na_2O) \quad \text{Equation 1b}$$

wherein in Equation 1 b, $INS_2$ is a total weight of the insulator;

$1.0 \le a/b \le 5.0$;

0.1% by weight≤e≤3.0% by weight;

0.1% by weight≤f≤3.0% by weight;

0.1% by weight≤g≤30.0% by weight;

0.1% by weight≤h≤2.2% by weight;

a+b+c+d+e+f+g+h+i is equal to 100% by weight;

c+d is equal to 100−a−b−e−f−g−h;

an amount of SrO is from about 0.1% by weight to about 10% by weight;

an amount of $Y_2O_3$ is less than about 5% by weight;

an amount of MgO is from about 0.1% by weight to about 25% by weight;

an amount of $TiO_2$ is from about 0.1% by weight to about 10% by weight;

an amount of $ZrO_2$ is from about 0.1% by weight to about 10% by weight; and an amount of $Na_2O$ is from 0% by weight to 2.2% by weight;

an electrode layer disposed on the insulating layer; and an electrically conductive layer disposed on the electrode layer.

* * * * *